US010682026B2

(12) United States Patent
Hayashida et al.

(10) Patent No.: US 10,682,026 B2
(45) Date of Patent: Jun. 16, 2020

(54) TOILET SEAT

(71) Applicant: TOTO LTD., Kitakyushu-shi, Fukuoka (JP)

(72) Inventors: Takeshi Hayashida, Kitakyushu (JP); Shuhei Nishiyama, Kitakyushu (JP); Nobuhiko Umeda, Kitakyushu (JP); Takeshi Inada, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 16/358,931

(22) Filed: Mar. 20, 2019

(65) Prior Publication Data

US 2019/0216275 A1 Jul. 18, 2019

Related U.S. Application Data

(63) Continuation of application No. PCT/JP2018/013641, filed on Mar. 30, 2018.

(30) Foreign Application Priority Data

Apr. 28, 2017 (JP) ..... 2017-090347
Jan. 19, 2018 (JP) ..... 2018-007137

(51) Int. Cl.
*A47K 13/10* (2006.01)
*A47K 13/02* (2006.01)

(52) U.S. Cl.
CPC ..... *A47K 13/105* (2013.01); *A47K 13/02* (2013.01)

(58) Field of Classification Search
CPC ..... A47K 13/02; A47K 13/305; A47K 13/307
See application file for complete search history.

(56) References Cited

U.S. PATENT DOCUMENTS 3,772,111 A * 11/1973 Ginsburg ..... A47K 13/02 156/79
5,079,783 A * 1/1992 Haletsky ..... A47K 13/307 4/217
2014/0223652 A1* 8/2014 Jin ..... B29C 45/0017 4/237

FOREIGN PATENT DOCUMENTS

JP 2008-105325 A 5/2008
JP 2017-055979 A 3/2017

OTHER PUBLICATIONS

English translation for Japanese Publication No. 2012-045170 published on Mar. 8, 2012 in the name of Panasonic Electric Works Co., Ltd.
English translation of JP 2000-272014, dated Oct. 3, 2000, corresponding to JP 3733778.
English translation of JP 2008-105325, dated May 8, 2008.

* cited by examiner

*Primary Examiner* — Janie M Loeppke
(74) *Attorney, Agent, or Firm* — Pearne & Gordon LLP

(57) ABSTRACT

A toilet seat includes a bottom plate, a top plate, and a bonding member. The top plate includes a sidewall part and a seating part. The sidewall part is provided on the bottom plate along a vertical direction. The seating part is supported by the sidewall part. The bonding member bonds the bottom plate and the sidewall part. The bonding member has an exposed surface exposed externally. The exposed surface is positioned below a central plane of the bottom plate and positioned outward of a central plane of the sidewall part.

4 Claims, 17 Drawing Sheets

TOILET SEAT

CROSS-REFERENCE TO RELATED APPLICATIONS

This is a continuation application of International Application PCT/JP2018/013641, filed on Mar. 30, 2018. This application also claims priority to Japanese Application No. 2017-090347, filed on Apr. 28, 2017, and Japanese Application No. 2018-007137, filed on Jan. 19, 2018; the entire contents of each are incorporated herein by reference.

FIELD

Aspects of the invention generally relate to a toilet seat.

BACKGROUND

For example, a toilet seat is configured by bonding a bottom plate provided on the toilet side to a top plate contacted by the buttocks. Patent Literature 1 describes technology in which these parts made of resin are bonded by filling a bonding resin into a passageway formed between the parts made of resin.

When a user of the toilet sits on the toilet seat, a load is applied to the toilet seat; and stress due to compression and stress due to tension are generated at the vicinity of the bonding part between the top plate and the bottom plate. The bonding member that bonds the top plate and the bottom plate is weaker than the top plate and the bottom plate. In particular, when an excessive stress is applied to an exposed surface of the bonding member exposed externally, peeling may occur and a gap may occur between the top plate and the bonding member or between the bottom plate and the bonding member. When the gap occurs in the toilet seat, dirt collects in the gap. The dirt that collects in the gap is not easy to remove when cleaning. Accordingly, when the gap occurs in the toilet seat, the cleanability of the toilet seat undesirably degrades.

SUMMARY

A toilet seat includes a bottom plate, a top plate, and a bonding member. The top plate includes a sidewall part and a seating part. The sidewall part is provided on the bottom plate along a vertical direction. The seating part is supported by the sidewall part. The bonding member bonds the bottom plate and the sidewall part. The bonding member has an exposed surface exposed externally. The exposed surface is positioned below a central plane of the bottom plate and positioned outward of a central plane of the sidewall part.

DETAILED DESCRIPTION

Figure 1:
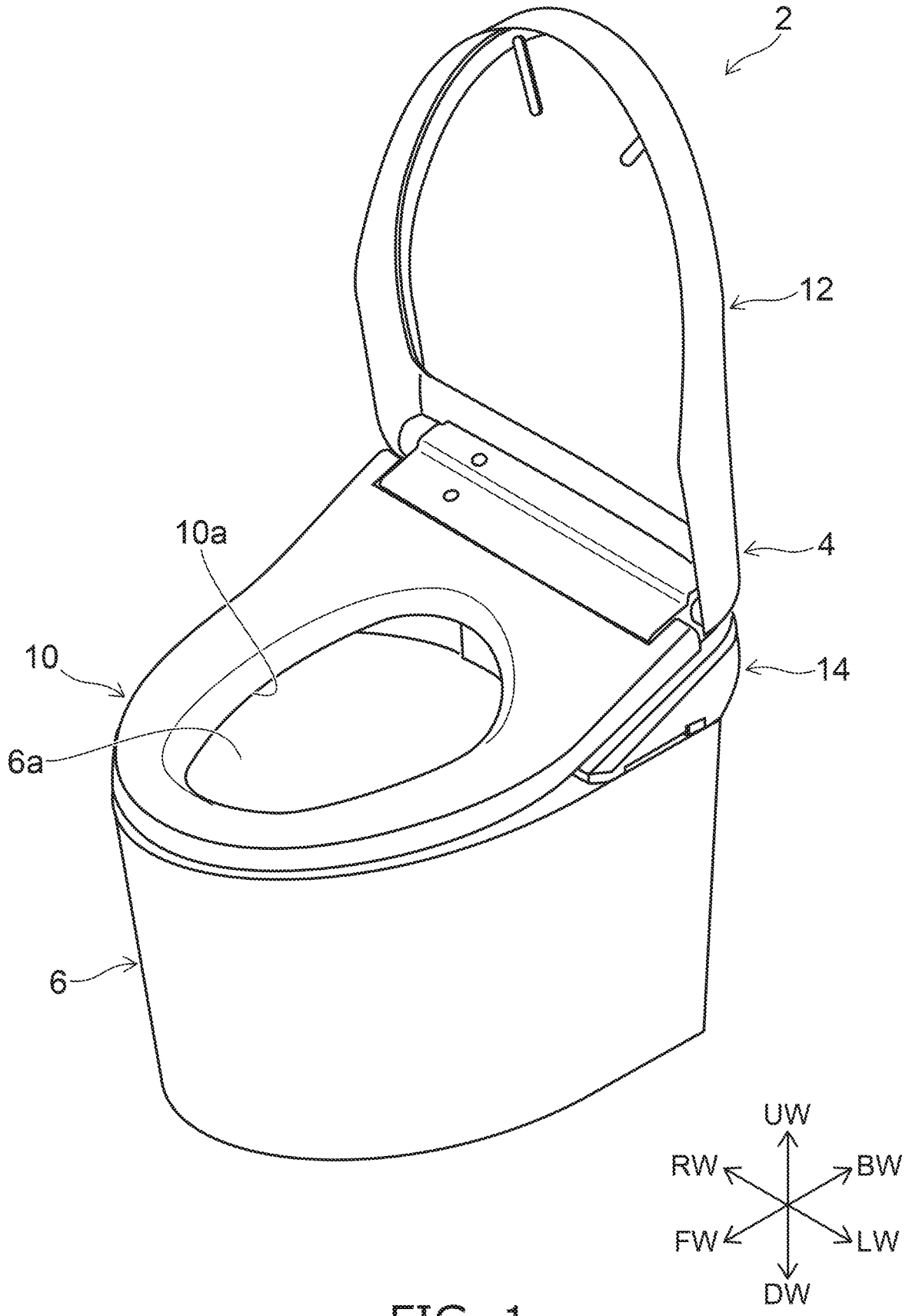
FIG. 1 is a perspective view illustrating a toilet device including a toilet seat according to an embodiment.

A first invention is a toilet seat that includes a bottom plate, a top plate, and a bonding member; the top plate includes a sidewall part provided on the bottom plate along a vertical direction, and a seating part supported by the sidewall part; the bonding member bonds the bottom plate and the sidewall part and has an exposed surface exposed externally; and the exposed surface is positioned below a central plane of the bottom plate and positioned outward of a central plane of the sidewall part.

According to the toilet seat, the stress that is generated at the exposed surface vicinity of the bonding member when the load is applied to the seating part can be reduced. Accordingly, the peeling of the bonding member can be suppressed; and the occurrence of the gap between the bottom plate and the bonding member or between the top plate and the bonding member can be suppressed.

A second invention is the toilet seat of the first invention that further includes an engaging part where the bottom plate and the sidewall part engage; and the engaging part is positioned above the central plane of the bottom plate and positioned inward of the central plane of the sidewall part.

According to the toilet seat, the stress that is generated at the exposed surface vicinity of the bonding member when the load is applied to the seating part can be reduced further. Accordingly, it is possible to further suppress the occurrence of the gap between the bottom plate and the bonding member or between the top plate and the bonding member.

A third invention is the toilet seat of the second invention, wherein the engaging part is provided in a lower end of an inner wall of the sidewall part.

According to the toilet seat, the stress that is generated at the exposed surface vicinity of the bonding member when the load is applied to the seating part can be reduced even more. Accordingly, it is possible to suppress the occurrence of the gap between the bottom plate and the bonding member or between the top plate and the bonding member even more.

A fourth invention is the toilet seat of any one of the first to third inventions, wherein the bottom plate includes a supporter and a protruding part; the supporter abuts the sidewall part from below and supports the sidewall part from below; the protruding part protrudes outward from the supporter; a hanging part is provided in a lower end of the sidewall part, extends downward, and is separated from the protruding part; at least a part of the bonding member is provided, in a horizontal direction, between the hanging part and the supporter and between the hanging part and the protruding part; and in the horizontal direction, a distance between the hanging part and the supporter is shorter than a distance between the hanging part and the supporter.

According to the toilet seat, the exposed surface is positioned further outward; and the distance from the central plane of the sidewall part is longer. Therefore, the stress that is generated in the exposed surface is relaxed further; and it is possible to further suppress the occurrence of the gap between the bottom plate and the bonding member or between the top plate and the bonding member.

Embodiments of the invention will now be described with reference to the drawings. Similar components in the drawings are marked with the same reference numerals; and a detailed description is omitted as appropriate.

FIG. 1 is a perspective view illustrating a toilet device including a toilet seat according to an embodiment.

As illustrated in FIG. 1, the toilet device 2 includes a toilet seat device 4 and a western-style sit-down toilet (hereinbelow, called simply the "toilet") 6.

The toilet seat device 4 is mounted on a toilet 6. The toilet seat device 4 may be mounted as one body with the toilet 6 or may be detachably mounted to the toilet 6. The toilet seat device 4 includes a toilet seat 10, a toilet lid 12, and a main part 14.

In this specification, upward when viewed by the user sitting on the toilet seat 10 is taken as "upward;" and downward when viewed by the user sitting on the toilet seat 10 is taken as "downward." The lateral directions when viewed by the user sitting on the toilet seat 10 with the user's back facing the toilet lid 12 in the open state are respectively taken as "leftward" and "rightward;" and the frontward and backward directions are respectively taken as "frontward" and "backward." FIG. 1 illustrates an example of upward UW, downward DW, leftward LW, rightward RW, frontward FW, and backward BW.

The toilet 6 includes a bowl part 6*a* recessed downward. The toilet 6 receives, in the bowl part 6*a*, excrement such as urine, feces, etc., of the user. The main part 14 of the toilet seat device 4 is provided at the upper part of the toilet 6 backward of the bowl part 6*a*. The main part 14 is pivotally supported by the toilet seat 10 and the toilet lid 12 to be openable and closable.

The toilet seat 10 has an opening 10*a*. The toilet seat 10 is provided on the toilet 6 to surround the outer edge of the bowl part 6*a*. The bowl part 6*a* is exposed via the opening 10*a*. Thereby, the user can excrete into the bowl part 6*a* in the state of sitting on the toilet seat 10. In the example, a so-called O-shaped toilet seat 10 is shown in which the opening 10*a* is formed in a through-hole configuration. The toilet seat 10 is not limited to being O-shaped and may be U-shaped, etc. A heater that warms the seating part (the part contacted by the buttocks of the user), etc., may be provided as appropriate inside the toilet seat 10.

Figure 2:
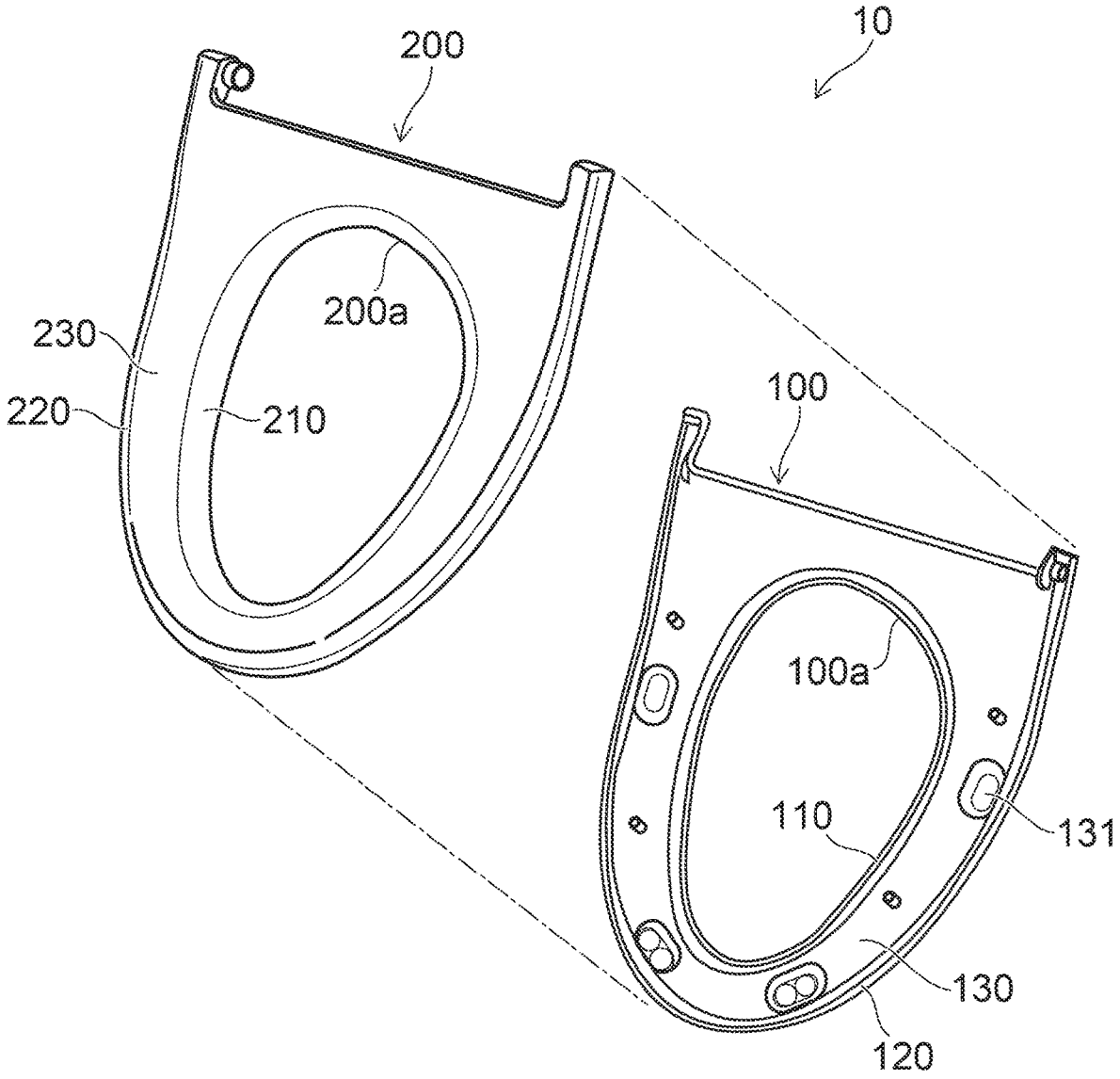
FIG. 2 is an exploded perspective view illustrating the toilet seat according to the embodiment.

FIG. 2 is an exploded perspective view illustrating the toilet seat according to the embodiment.

Figure 3:
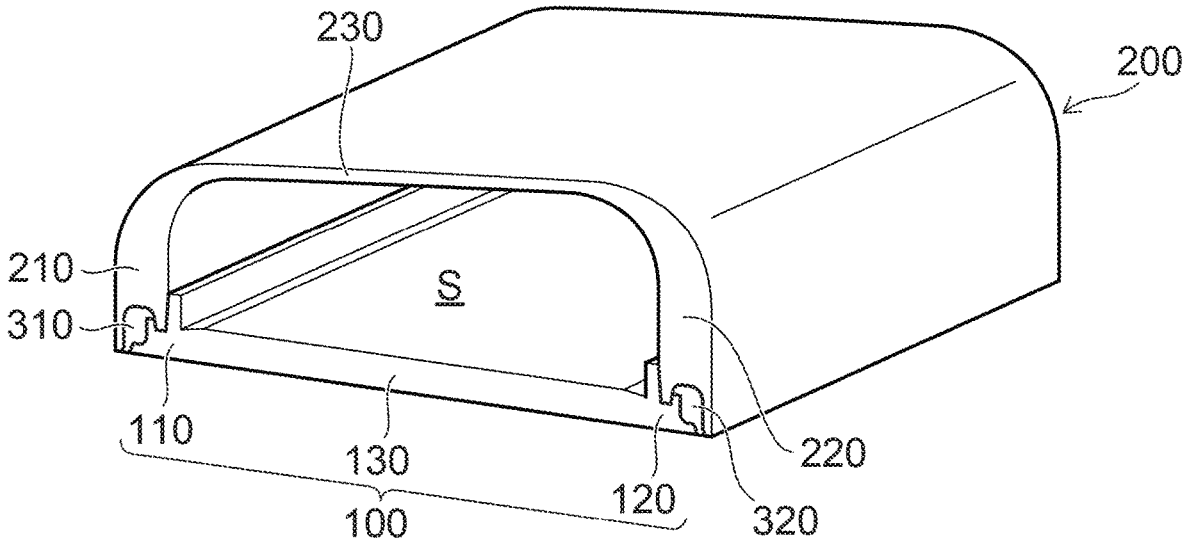
FIG. 3 is a perspective cross-sectional view illustrating a part of the toilet seat according to the embodiment.

FIG. 3 is a perspective cross-sectional view illustrating a part of the toilet seat according to the embodiment.

As illustrated in FIG. 2 and FIG. 3, the toilet seat 10 includes a bottom plate 100 and a top plate 200. The top plate 200 is provided on the bottom plate 100; and the bottom plate 100 and the top plate 200 are bonded by a bonding member 310 and a bonding member 320.

A more specific structure of the toilet seat 10 will now be described. Here, the directions of "upward," "downward," etc., are referenced to the state in which the bottom plate 100 of the toilet seat 10 is placed on a horizontal surface.

As illustrated in FIG. 2, the bottom plate 100 and the top plate 200 respectively have an opening 100*a* and an opening 200*a*. The configurations of the bottom plate 100 and the top plate 200 when viewed from above are substantially the same as the configuration of the toilet seat 10 when viewed from above. In other words, the configurations of the bottom plate 100 and the top plate 200 when viewed from above are ring configurations or U-shaped configurations. The opening 10*a* of the toilet seat 10 is formed of the opening 100*a* of the bottom plate 100 and the opening 200*a* of the top plate 200.

The bottom plate 100 includes an inner perimeter supporter 110, an outer perimeter supporter 120, and a bottom plate base part 130. The thickness of the bottom plate base part 130 is substantially uniform. For example, the front part of the bottom plate base part 130 is provided along the horizontal direction. The back part of the bottom plate base part 130 is tilted upward. A support leg 131 that contacts the upper surface of the toilet 6 is appropriately provided in the bottom plate base part 130. The inner perimeter supporter 110 is provided toward the inner perimeter of the toilet seat 10 with respect to the bottom plate base part 130. The outer perimeter supporter 120 is provided toward the outer perimeter of the toilet seat 10 with respect to the bottom plate base part 130.

The top plate 200 includes an inner perimeter sidewall part 210, an outer perimeter sidewall part 220, and a seating part 230. The seating part 230 supports, from below, the buttocks of the user seated on the toilet seat 10. The seating part 230 is supported from below by the inner perimeter sidewall part 210 and the outer perimeter sidewall part 220. The inner perimeter sidewall part 210 is provided toward the inner perimeter of the toilet seat 10 with respect to the seating part 230. The outer perimeter sidewall part 220 is provided toward the outer perimeter of the toilet seat 10 with respect to the seating part 230.

As illustrated in FIG. 3, the inner perimeter sidewall part 210 and the outer perimeter sidewall part 220 are provided respectively on the inner perimeter supporter 110 and the outer perimeter supporter 120. The lower end of the inner perimeter sidewall part 210 is bonded to the inner perimeter supporter 110 by the bonding member 310. The lower end of the outer perimeter sidewall part 220 is bonded to the outer perimeter supporter 120 by the bonding member 320.

The bottom plate base part 130 and the seating part 230 are separated in the vertical direction. The inner perimeter sidewall part 210 and the outer perimeter sidewall part 220 are separated in the horizontal direction. Thereby, an interior space S is formed in the toilet seat 10 and surrounded with the bottom plate 100 and the top plate 200.

In the case where the toilet seat 10 is U-shaped, etc., the inner perimeter supporter 110 and the outer perimeter supporter 120 may be linked around the bottom plate base part 130; and the inner perimeter sidewall part 210 and the outer perimeter sidewall part 220 may be linked around the seating part 230. In such a case, the bonding member 310 and the bonding member 320 may be continuous around the bottom plate base part 130 and may be provided as one body.

Figure 4:
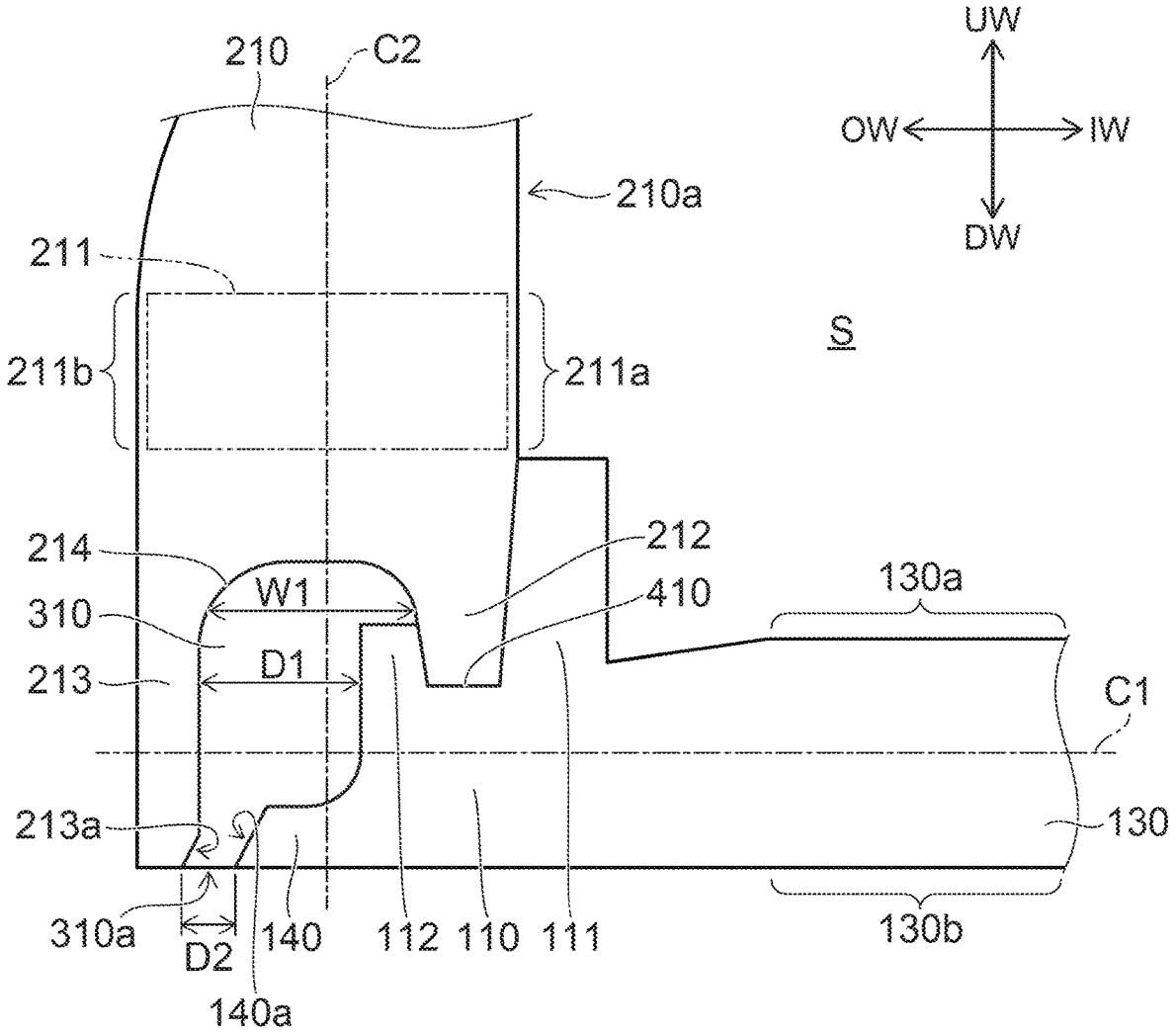
FIG. 4 is a cross-sectional view in which parts of the cross section of FIG. 3 are enlarged.
Figure 5:
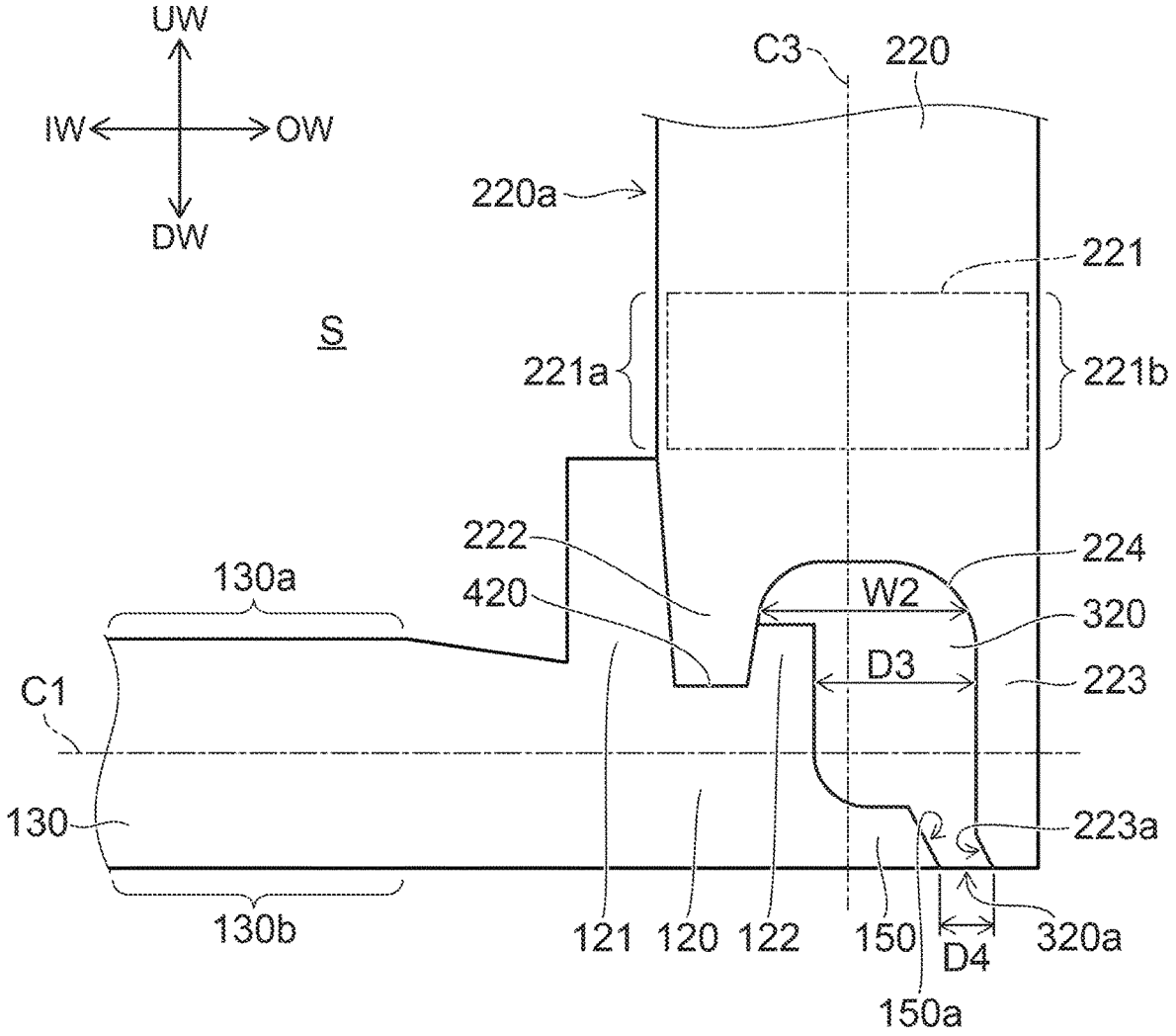
FIG. 5 is a cross-sectional view in which parts of the cross section of FIG. 3 are enlarged.

FIG. 4 and FIG. 5 are cross-sectional views in which parts of the cross section of FIG. 3 are enlarged.

FIG. 4 illustrates a part of the inner perimeter supporter 110 and a part of the inner perimeter sidewall part 210. FIG. 5 illustrates a part of the outer perimeter supporter 120 and a part of the outer perimeter sidewall part 220.

In this specification, the direction from the interior space S toward the top plate 200 along the horizontal direction is taken as "outward." The direction from the top plate 200 toward the interior space S along the horizontal direction is taken as "inward." Inward IW and outward OW are illustrated in FIG. 4 as referenced to the inner perimeter sidewall part 210. Inward IW and outward OW are illustrated in FIG. 5 as referenced to the outer perimeter sidewall part 220.

As illustrated in FIG. 4, the inner perimeter supporter 110 includes an inner rib 111 and an outer rib 112. The inner perimeter sidewall part 210 includes a sidewall base part 211, an insertion part 212, a hanging part 213, and a recess 214.

The inner rib 111 and the outer rib 112 protrude upward. For example, the inner rib 111 faces the interior space S. The outer rib 112 is provided outward of the inner rib 111 and is separated from the inner rib 111. Thereby, the recess 214 that is recessed downward is formed between the inner rib 111 and the outer rib 112.

The thickness in the vertical direction of the sidewall base part 211 is substantially constant. For example, the thickness of the sidewall base part 211 is larger than the thicknesses of the other parts of the inner perimeter sidewall part 210. The insertion part 212 is positioned below the sidewall base part 211 and is provided between the inner rib 111 and the outer rib 112. An engaging part 410 is positioned at the lower end of the insertion part 212. The engaging part 410 is interposed between the inner rib 111 and the outer rib 112 and abuts the inner perimeter supporter 110. In other words, an uneven structure that engages in the vertical direction is provided in the inner perimeter supporter 110 and the inner perimeter sidewall part 210.

A part of the load when the user is seated on the seating part 230 is applied to the inner perimeter sidewall part 210. At this time, the load that is transmitted to the insertion part 212 is supported from below by the inner perimeter supporter 110. A protruding part 140 is positioned outward of the inner perimeter supporter 110 and protrudes outward from the inner perimeter supporter 110.

The hanging part 213 is provided below the sidewall base part 211 and extends downward. The hanging part 213 is provided outward of the insertion part 212 and is separated from the insertion part 212. Thereby, the recess 214 that is recessed upward is formed between the insertion part 212 and the hanging part 213. The outer rib 112 is provided between the insertion part 212 and the hanging part 213 and is positioned inside the recess 214.

The protruding part 140 is positioned below the recess 214 and is separated from the recess 214 in the vertical direction. The hanging part 213 is separated from the outer rib 112 in the horizontal direction. The lower end of the hanging part 213 is separated from the protruding part 140 in the horizontal direction. The bonding member 310 that bonds the inner perimeter supporter 110 and the inner perimeter sidewall part 210 is provided in the space formed by these members separated in the vertical direction and the horizontal direction.

The bonding member 310 has an exposed surface 310*a* that is exposed externally. For example, the exposed surface 310*a* is at the same height as the bottom surface of the protruding part 140 and the lower end of the hanging part 213. For example, the exposed surface 310*a* is provided between the bottom surface of the protruding part 140 and the lower end of the hanging part 213. In other words, for example, the bottom surface of the protruding part 140, the exposed surface 310*a*, and the lower end of the hanging part 213 are provided to be coplanar along the horizontal direction.

The exposed surface 310*a* is positioned below a central plane C1 of the bottom plate 100. The central plane C1 is a plane obtained by connecting center points of the thickness of the bottom plate 100. For example, the central plane C1 is obtained based on the thickness of the bottom plate base part 130 being substantially uniform.

Specifically, the central plane C1 is obtained by the following method. The bottom plate base part 130 has an upper surface 130*a* facing the interior space S, and a bottom surface 130*b* exposed externally. Any point on the upper surface 130*a* and the point on the bottom surface 130*b* most proximal to the point on the upper surface 130*a* are connected by a line segment. The center point of the line segment is determined. Multiple center points are determined similarly along the circumferential direction of the bottom plate 100. The central plane C1 is obtained by extending a line segment connecting the multiple center points in the horizontal direction.

The exposed surface 310*a* also is positioned outward of a central plane C2 of the inner perimeter sidewall part 210. The central plane C2 is a plane obtained by connecting center points of the thickness of the inner perimeter sidewall part 210. For example, the central plane C2 is obtained based on the thickness of the sidewall base part 211 being substantially uniform.

Specifically, the central plane C2 is obtained by the following method. The sidewall base part 211 has an inner surface 211*a* facing the interior space S, and an outer surface 211*b* exposed externally. The inner surface 211*a* and the outer surface 211*b* are substantially parallel to the vertical direction. Any point on the inner surface 211*a* and the point on the outer surface 211*b* most proximal to the point on the inner surface 211*a* are connected by a line segment. The center point of the line segment is determined. Multiple center points are determined similarly along the circumferential direction of the inner perimeter sidewall part 210. The central plane C2 along the vertical direction is obtained by extending the line segment connecting the multiple center points in the vertical direction.

A distance D1 between the outer rib 112 and the hanging part 213 in the horizontal direction is shorter than a width W1 of the recess 214. A distance D2 between the protruding part 140 and the lower end of the hanging part 213 in the horizontal direction is shorter than the distance D1. Therefore, the width in the horizontal direction of the bonding member 310 becomes narrow downward.

For example, a tip surface 140*a* of the protruding part 140 is tilted along a direction downward and outward. For example, a tip surface 213*a* of the hanging part 213 is tilted along a direction outward and downward. Therefore, the bonding member 310 at the exposed surface 310*a* vicinity is provided to extend outward and downward between the tip surface 140*a* and the tip surface 213*a*.

As illustrated in FIG. 5, the outer perimeter supporter 120 includes an inner rib 121 and an outer rib 122. The outer perimeter sidewall part 220 includes a sidewall base part 221, an insertion part 222, a hanging part 223, and a recess 224. For example, the structures of the outer perimeter supporter 120 and the outer perimeter sidewall part 220 at the bonding member 320 vicinity are substantially symmetric in the horizontal direction respectively to the structures of the inner perimeter supporter 110 and the inner perimeter sidewall part 210 at the bonding member 310 vicinity.

In other words, an engaging part 420 of the lower end of the insertion part 222 engages the inner rib 121 and the outer rib 122. The insertion part 222 is supported from below by the outer perimeter supporter 120. A protruding part 150 is positioned outward of the outer perimeter supporter 120. The protruding part 150 protrudes outward from the outer perimeter supporter 120.

The protruding part 150 is separated from the recess 224 in the vertical direction. The hanging part 223 is separated from the outer rib 122 and the protruding part 150 in the horizontal direction. The bonding member 320 is provided in the space surrounded with the protruding part 150, the outer rib 122, the hanging part 223, and the recess 224. The bonding member 320 bonds the outer perimeter supporter 120 and the outer perimeter sidewall part 220.

The bonding member 320 has an exposed surface 320*a* that is exposed externally. For example, the exposed surface 320*a* is at the same height as the bottom surface of the protruding part 150 and the lower end of the hanging part 223. For example, the exposed surface 320*a* is provided between the bottom surface of the protruding part 150 and the lower end of the hanging part 223. In other words, for example, the bottom surface of the protruding part 150, the exposed surface 320*a*, and the lower end of the hanging part 223 are provided to be coplanar along the horizontal direction.

The exposed surface 320*a* is positioned below the central plane C1 of the bottom plate 100 and positioned outward of a central plane C3 of the outer perimeter sidewall part 220. The central plane C3 is obtained similarly to the central plane C2.

Namely, the central plane C3 is obtained by the following method. The sidewall base part 221 has an inner surface 221*a* facing the interior space S, and an outer surface 221*b* exposed externally. The inner surface 221*a* and the outer surface 221*b* are substantially parallel to the vertical direction. Any point on the inner surface 221*a* and the point on the outer surface 221*b* most proximal to the point on the inner surface 221*a* are connected by a line segment. The center point of the line segment is determined. Multiple center points are determined similarly along the circumferential direction of the outer perimeter sidewall part 220. The central plane C3 along the vertical direction is obtained by extending a line segment connecting the multiple center points in the vertical direction.

A distance D3 between the outer rib 122 and the hanging part 223 in the horizontal direction is shorter than a width W2 of the recess 224. A distance D4 between the protruding part 150 and the lower end of the hanging part 223 in the horizontal direction is shorter than the distance D3. For example, a tip surface 150*a* of the protruding part 150 is tilted along a direction downward and outward. For example, a tip surface 223*a* of the hanging part 223 is tilted along a direction outward and downward.

The bottom plate 100, the top plate 200, the bonding member 310, and the bonding member 320 include resin. The bottom plate 100, the top plate 200, the bonding member 310, and the bonding member 320 include, for example, polypropylene, ABS (Acrylonitrile-Butadiene-Styrene), PBT (Polybutylene Terephthalate), a polycarbonate composite material, etc. The bottom plate 100, the top plate 200, the bonding member 310, and the bonding member 320 may be made of resin.

Figure 6:
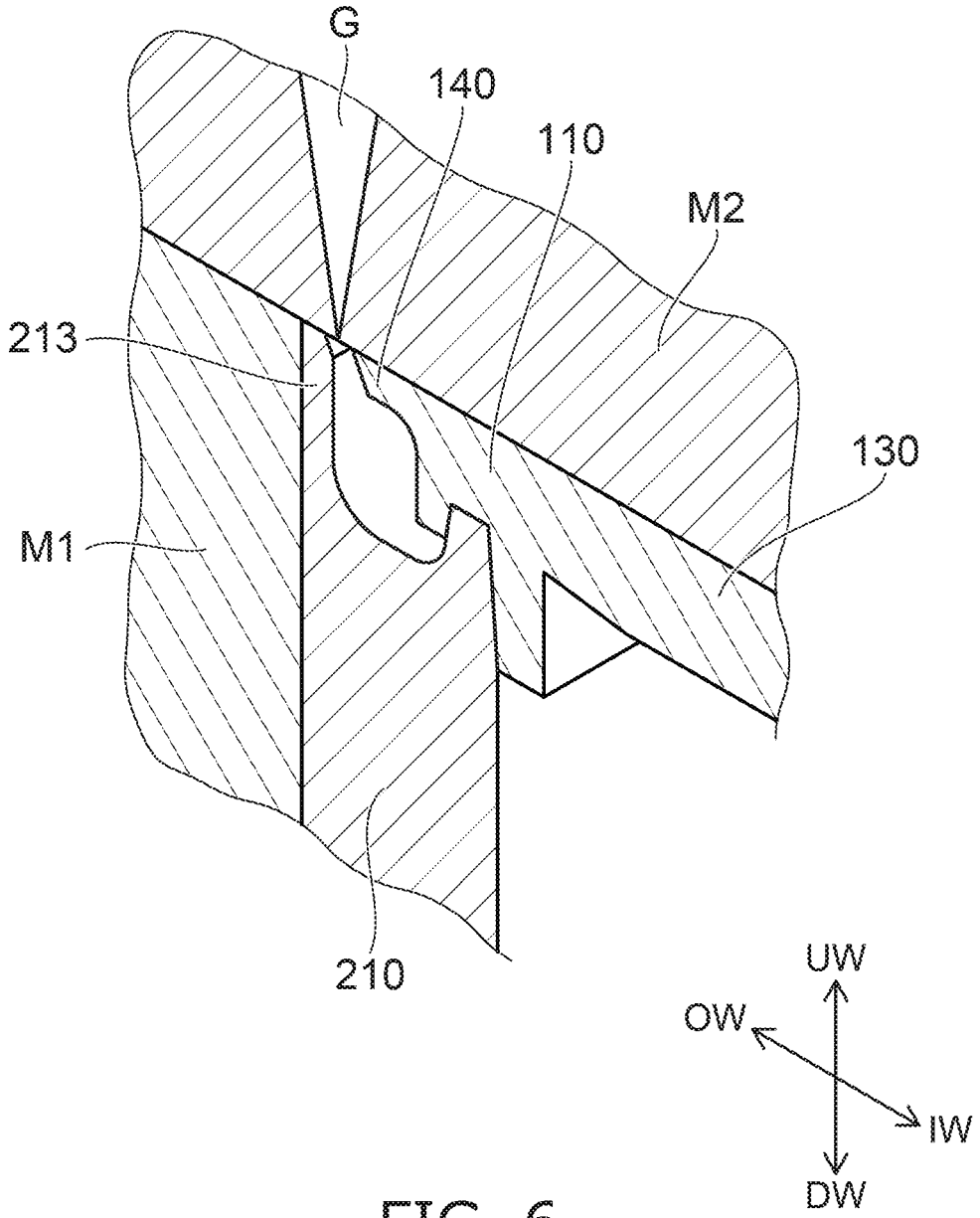
FIG. 6 is a cross-sectional view illustrating a manufacturing process of the toilet seat according to the embodiment.

FIG. 6 is a cross-sectional view illustrating a manufacturing process of the toilet seat according to the embodiment. FIG. 6 illustrates a part of the inner perimeter supporter 110 and a part of the inner perimeter sidewall part 210.

As described above, the structures of the outer perimeter supporter 120 and the outer perimeter sidewall part 220 at the bonding member 320 vicinity are respectively substantially similar to the structures of, for example, the inner perimeter supporter 110, and the inner perimeter sidewall part 210 at the bonding member 310 vicinity. Therefore, here, the manufacturing process of the toilet seat 10 is described using the part of the inner perimeter supporter 110 and the part of the inner perimeter sidewall part 210 as an example.

First, the top plate 200 is placed with the seating part 230 downward; and the bottom plate 100 is disposed on the top plate 200. At this time, as illustrated in FIG. 6, the engaging part 410 of the inner perimeter sidewall part 210 abuts the inner perimeter supporter 110; and the inner perimeter supporter 110 is disposed on the inner perimeter sidewall part 210 so that a gap is formed between the protruding part 140 and the hanging part 213.

In this state, a mold M1 is disposed sideward of the top plate 200; and the bottom plate 100 is pressed from above by a mold M2. A gate G for injecting a resin as the bonding member 310 is provided in the mold M2. The mold M2 is disposed on the top plate 200 so that the gate G is positioned at the gap between the protruding part 140 and the hanging part 213.

In this state, a heated resin is injected from the gate G into the gap between the protruding part 140 and the hanging part 213. When the heated resin is injected into the gap, the surfaces of the bottom plate 100 and the top plate 200 in contact with the resin are melted by the heat and mix with the resin. Subsequently, the bottom plate 100 and the top plate 200 are bonded by cooling and curing the resin. After bonding the bottom plate 100 and the top plate 200, beveling of the tip of the hanging part 213, deburring of the resin, etc., may be performed as appropriate. Thus, the toilet seat 10 according to the embodiment is made.

Effects of the embodiment will now be described with reference to FIG. 7.

Figure 7:
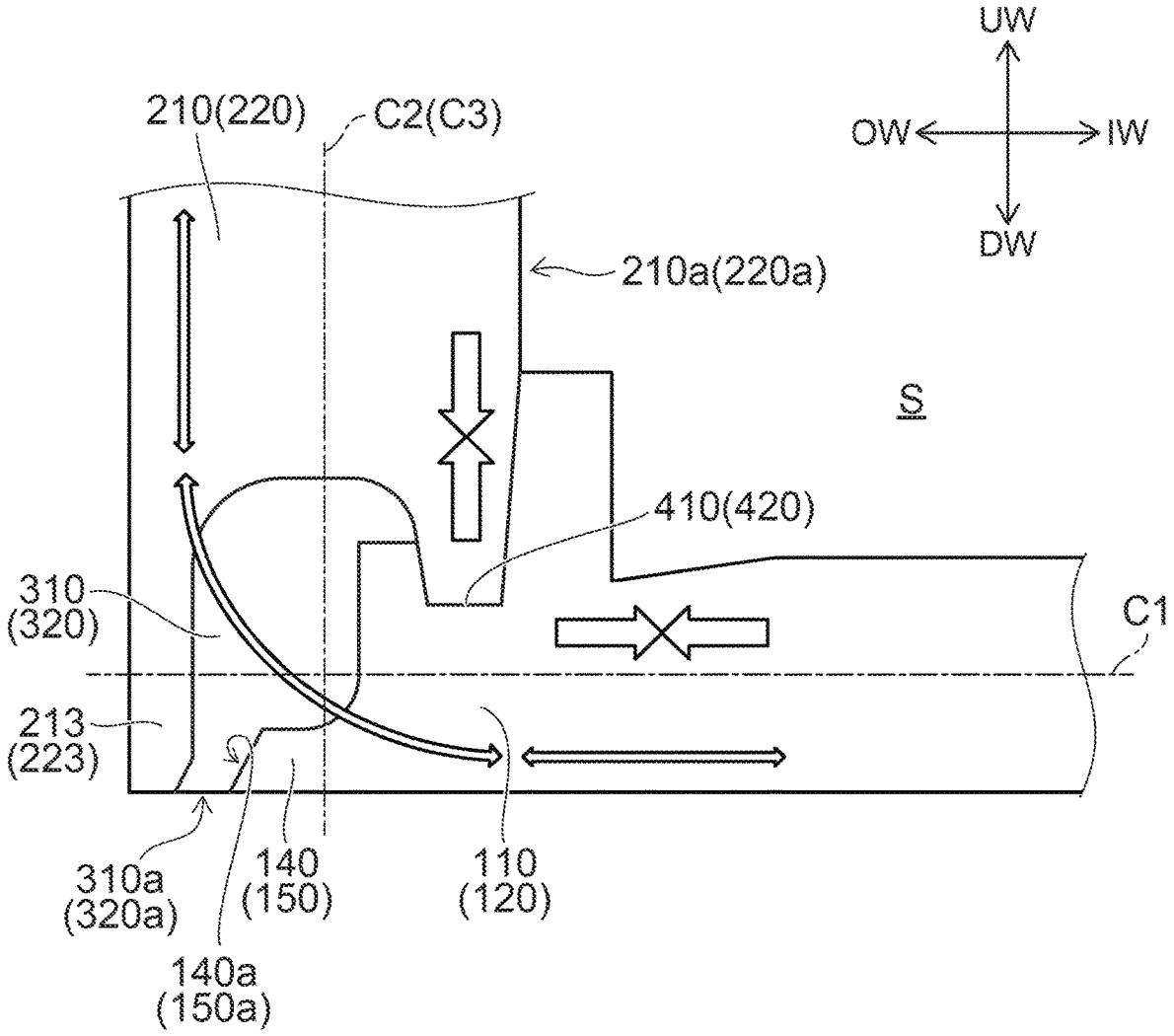
FIG. 7 is a cross-sectional view showing characteristics of the toilet seat.

FIG. 7 is a cross-sectional view showing characteristics of the toilet seat. FIG. 7 schematically illustrates the regions where the largest stress (the maximum compressive stress) due to compression and the largest stress (the maximum tensile stress) due to tension are generated when a load is applied downward to the seating part 230.

The effects due to the structures of the inner perimeter supporter 110 and the inner perimeter sidewall part 210 and the effects due to the structures of the outer perimeter supporter 120 and the outer perimeter sidewall part 220 are described collectively with reference to FIG. 7.

When the load is applied to the seating part 230 by the user being seated, etc., compressive stress is generated at an upper part of the bottom plate 100 and an inner part of the sidewall part 210 (220). Tensile stress is generated at a lower part of the bottom plate 100 and an outer part of the sidewall part 210 (220). As illustrated in FIG. 7, the tensile stress is the largest at the bottom surface vicinity and the outer surface vicinity respectively of the supporter 110 (120) and the sidewall part 210 (220). In the location where the supporter 110 (120) and the sidewall part 210 (220) are bonded, multiple points (lines) where the maximum tensile stress is generated are curved to pass proximally to the intersection between the central plane C1 and the central plane C2 (C3).

In the case where the exposed surface 310*a* (320*a*) of the bonding member 310 (320) is positioned in the region where the maximum tensile stress is generated, the bonding member 310 (320) peels easily from the bottom plate 100 and the sidewall part 210 (220) when the load is applied to the toilet seat 10. As a result, gaps occur easily between the bonding member 310 (320) and the sidewall part 210 (220) and between the bonding member 310 (320) and the bottom plate 100. When the gaps occur, dirt collects inside the gaps; and the cleanability of the toilet seat 10 undesirably degrades.

For this problem, in the toilet seat 10 according to the embodiment, the exposed surface 310*a* (320*a*) is positioned below the central plane C1 of the bottom plate 100 and positioned outward of the central plane C2 (C3) of the sidewall part 210 (220). In other words, the exposed surface 310*a* (320*a*) is provided in a region where the tensile stress is smaller. Thereby, the peeling of the bonding member 310 (320) when the load is applied to the toilet seat 10 does not occur easily; and the occurrence of the gap around the exposed surface 310*a* (320*a*) can be suppressed. Accordingly, according to the embodiment, it is possible to keep the toilet seat 10 cleaner and to suppress the degradation of the cleanability of the toilet seat 10 due to the occurrence of gaps.

The position of the engaging part 410 (420) can be modified as appropriate. For example, the engaging part 410 (420) may be positioned below the central plane C1. The engaging part 410 (420) may be positioned outward of the central plane C2 (C3).

In the case where the engaging part 410 (420) is positioned below the central plane C1, the thickness of the supporter 110 (120) abutted by the engaging part 410 (420) becomes small. Thereby, there is a possibility that the strength of the supporter 110 (120) may decrease. The position where the engaging part 410 (420) is provided affects the position where the compressive stress is generated and the position where the tensile stress is generated. Specifically, a larger compressive stress is generated in the region where the engaging part 410 (420) is provided. There is a tendency for the tensile stress to increase outward and downward from the engaging part 410 (420). Therefore, the tensile stress that is generated in the exposed surface 310*a* (320*a*) may become large in the case where the engaging part 410 (420) is positioned below the central plane C1 or the engaging part 410 (420) is positioned outward of the central plane C2 (C3) and the distance between the engaging part 410 (420) and the exposed surface 310*a* (320*a*) decreases.

Accordingly, it is desirable for the engaging part 410 (420) to be positioned above the central plane C1 and positioned inward of the central plane C2 (C3). According to such a configuration, the tensile stress that is generated in the exposed surface 310*a* (320*a*) can be even more relaxed while increasing the strength by increasing the thickness of the supporter 110 (120). In other words, it is possible to suppress the occurrence of the gap around the exposed surface 310*a* (320*a*) even more.

In particular, it is desirable for the engaging part 410 (420) to be provided in the lower end of an inner wall 210*a* (220*a*) of the sidewall part 210 (220) as illustrated in FIG. 4 and FIG. 5. According to this configuration, the stress that is generated at the contact surface between the supporter 110 (120) and the sidewall part 210 (220) can be relaxed effectively.

To further suppress the occurrence of the gap around the exposed surface 310*a* (320*a*), it is desirable for the distance between the exposed surface 310*a* (320*a*) and the central plane C2 (C3) to be longer. Therefore, by providing the protruding part 140 (150) as illustrated in FIG. 4 and FIG. 5, the exposed surface 310*a* (320*a*) can be positioned further outward. Further, by providing the protruding part 140 (150), the width of the exposed surface 310*a* (320*a*) can be narrow. By setting the width of the exposed surface 310*a* (320*a*) to be narrow, the resin that is injected between the protruding part 140 (150) and the hanging part 213 (223) does not cool easily. As a result, the bottom plate 100 and the top plate 200 are in contact for a longer time in the state in which the resins are heated. The bonding strength between the bottom plate 100 and the top plate 200 can be increased thereby.

It is desirable for the tip surface 140*a* (150*a*) of the protruding part 140 (150) to be tilted in a direction downward and outward. As illustrated in FIG. 4 and FIG. 5, the distance D1 (D3) is longer than the distance D2 (D4); and the width of the bonding member 310 (320) increases inward. Accordingly, compared to the case where the tip surface 140*a* (150*a*) is parallel to the vertical direction, it is easy to provide the bonding member 310 (320) between the supporter 110 (120) and the hanging part 213 (223) in the case where the tip surface 140*a* (150*a*) is tilted along a direction downward and outward. According to this configuration, even when a void occurs in the bonding member 310 (320) between the hanging part 213 (223) and the supporter 110 (120), the distance between the void and the exposed surface 310*a* (320*a*) can be lengthened. The effects of sink marks in the exposed surface 310*a* and the exposed surface 320*a* can be suppressed thereby. Further, the stress that is applied to the bonding surface between the bonding member 310 (320) and the supporter 110 (120) and between the bonding member 310 (320) and the sidewall part 210 (220) can be dispersed more because the surface area of the bonding surface can be increased. Therefore, it is possible to increase the bonding strength between the supporter 110 (120) and the sidewall part 210 (220).

The inner perimeter supporter 110 and the inner perimeter sidewall part 210 described above may be bonded by the bonding member 310 over the entire inner perimeter of the toilet seat 10. A part of the inner perimeter supporter 110 and a part of the inner perimeter sidewall part 210 may be bonded by the bonding member 310. In the case where the bonding member 310 is provided over the entire inner perimeter of the toilet seat 10, the entire exposed surface 310*a* may be positioned below the central plane C1 and outward of the central plane C2. Only a part of the exposed surface 310*a* may be positioned below the central plane C1 and outward of the central plane C2.

To increase the bonding strength between the inner perimeter supporter 110 and the inner perimeter sidewall part 210, it is desirable for the bonding member 310 to be provided over the entire inner perimeter of the toilet seat 10. To suppress the occurrence of gaps in the toilet seat 10 more reliably, it is desirable for the entire exposed surface 310*a* to be positioned below the central plane C1 and outward of the central plane C2.

Similarly, the bonding member 320 may be provided at only a part of the outer perimeter of the toilet seat 10 or may be provided at the entire outer perimeter. The entire exposed surface 320*a* may be positioned below the central plane C1 and outward of the central plane C3. Only a part of the exposed surface 320*a* may be positioned below the central plane C1 and outward of the central plane C3.

To increase the bonding strength between the outer perimeter supporter 120 and the outer perimeter sidewall part 220, it is desirable for the bonding member 320 to be provided over the entire outer perimeter of the toilet seat 10. To suppress the occurrence of gaps in the toilet seat 10 more reliably, it is desirable for the entire exposed surface 320*a* to be positioned below the central plane C1 and outward of the central plane C3.

A more desirable embodiment of the toilet seat according to the embodiment will now be described with reference to FIG. 8.

Figure 8:
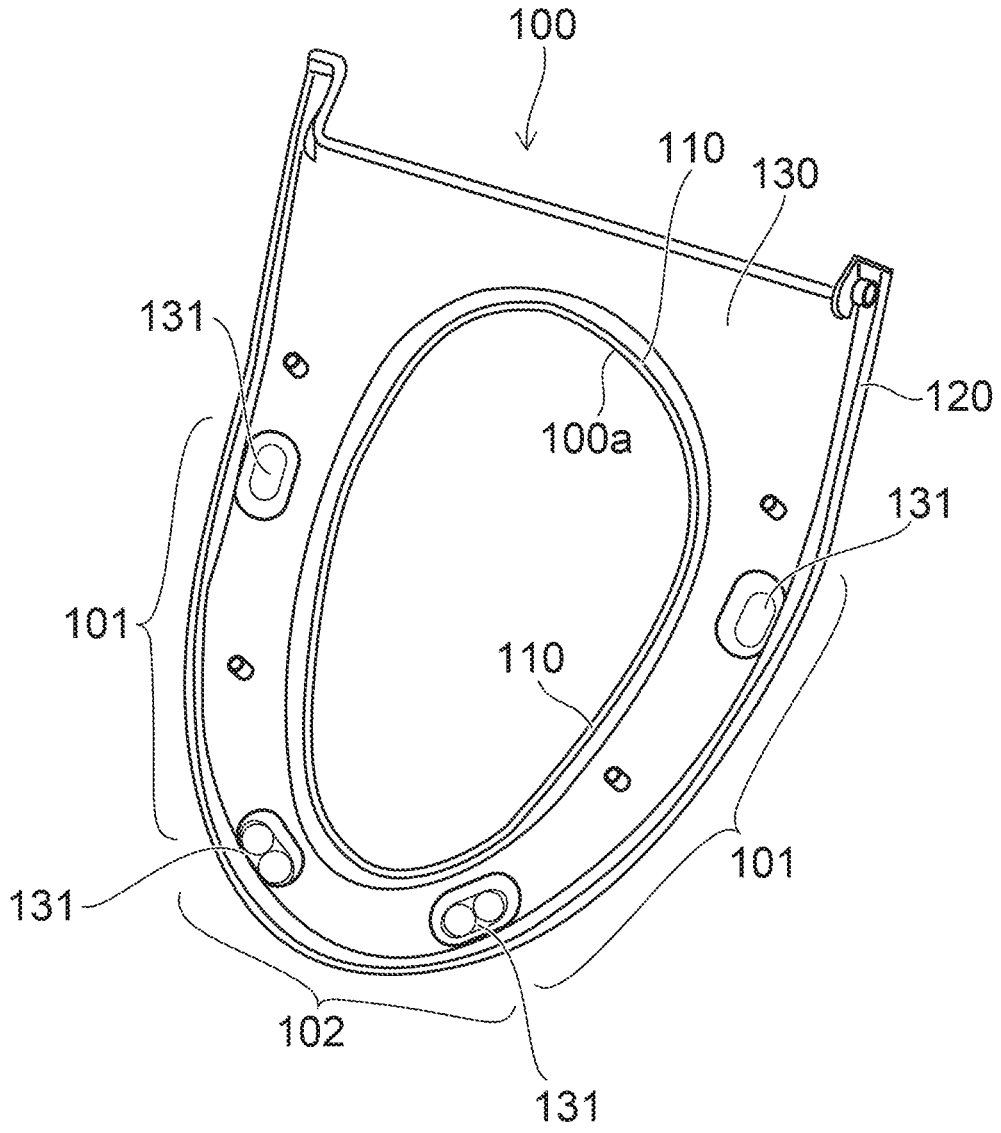
FIG. 8 is a perspective view illustrating the bottom plate of the toilet seat according to the embodiment.

FIG. 8 is a perspective view illustrating the bottom plate of the toilet seat according to the embodiment.

As illustrated in FIG. 8, the bottom plate 100 includes, for example, a side part 101 and a front part 102. The side part 101 is positioned sideward of an opening 100*a* of the bottom plate 100. The front part 102 is positioned frontward of the opening 100*a*. For example, the side part 101 is positioned below the leg (the thigh) of the user when the user is seated on the toilet seat 10.

As described above, the support legs 131 are provided in the side part 101 and the front part 102. The support legs 131 are multiply provided in the circumferential direction of the toilet seat 10 and are separated from each other. The load that is applied to the bottom plate 100 when the user is seated on the toilet seat 10 is transmitted from the support legs 131 to the toilet 6. For example, the stress that is generated at the vicinities of the support legs 131 easily becomes larger than the stress generated at the parts between the support legs 131.

Accordingly, in the embodiment, it is desirable for at least the exposed surface 310*a* of the part of the bonding member 310 bonding the top plate 200 and the bottom plate 100 at the vicinities of the support legs 131 to be positioned below the central plane C1 and positioned outward of the central plane C2.

Similarly, in the embodiment, it is desirable for at least the exposed surface 320*a* of the part of the bonding member 320 bonding the top plate 200 and the bottom plate 100 at the vicinities of the support legs 131 to be positioned below the central plane C1 and positioned outward of the central plane C3.

Applying the embodiment to the exposed surface 310*a* and the exposed surface 320*a* provided at the parts where a larger stress is generated easily reduces the stress generated at these exposed surfaces; and it is possible to suppress the occurrence of gaps in the toilet seat 10 effectively.

When the user is seated, the stress that is generated at the vicinity of the support leg 131 is larger for the side part 101 where the body weight is applied than for the front part 102.

Accordingly, it is more desirable for the embodiment to be applied to at least the exposed surface 310*a* and an exposed surface 320*b* of the parts of the bonding member 310 and the bonding member 320 bonding the top plate 200 and the side part 101 at the vicinities of the support legs 131. Thereby, it is possible to suppress the occurrence of gaps in the toilet seat 10 more effectively.

The case where the toilet seat 10 is O-shaped is described in FIG. 8. The toilet seat 10 may be U-shaped, etc. In the case where the toilet seat 10 is U-shaped, the bottom plate 100 does not include the front part 102. However, similarly to the case where the toilet seat 10 is O-shaped, a large load is applied to the side part 101 when the user is seated on the toilet seat 10.

The structure of the toilet seat 10 according to the embodiment is not limited to the examples described above; and various modifications are possible.

Figure 15:
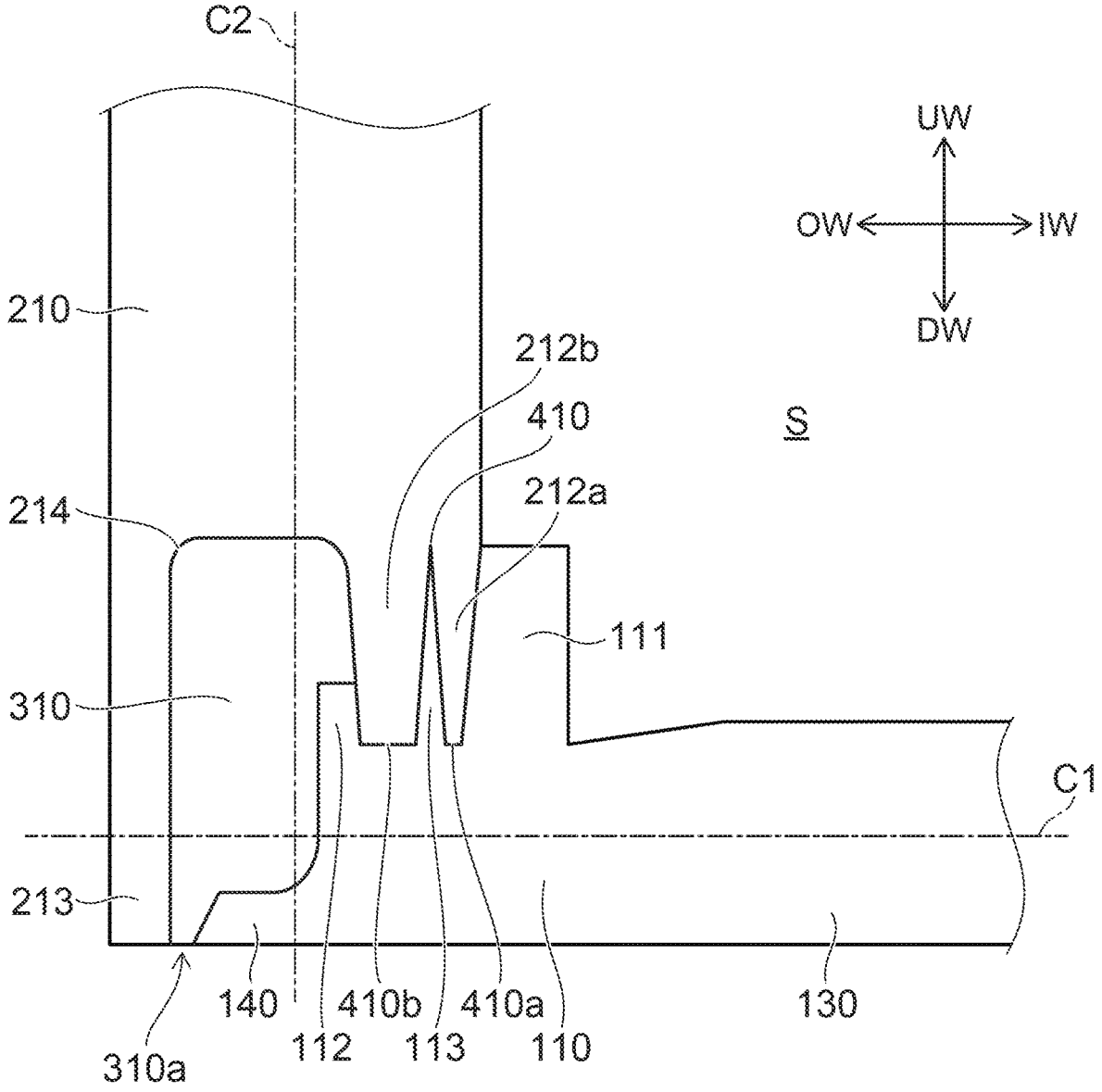
FIG. 15 is a cross-sectional view illustrating parts of toilet seats according to modifications of the embodiment.
Figure 16A:
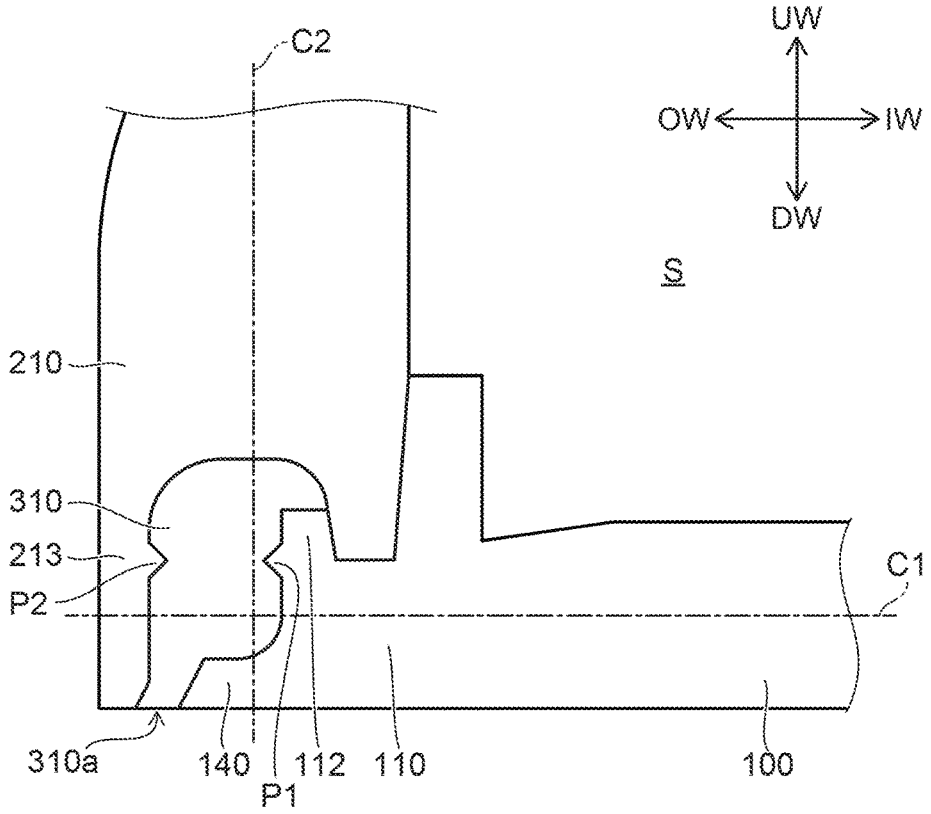
FIGS. 16A and 16B are cross-sectional views illustrating parts of toilet seats according to modifications of the embodiment.
Figure 16B:
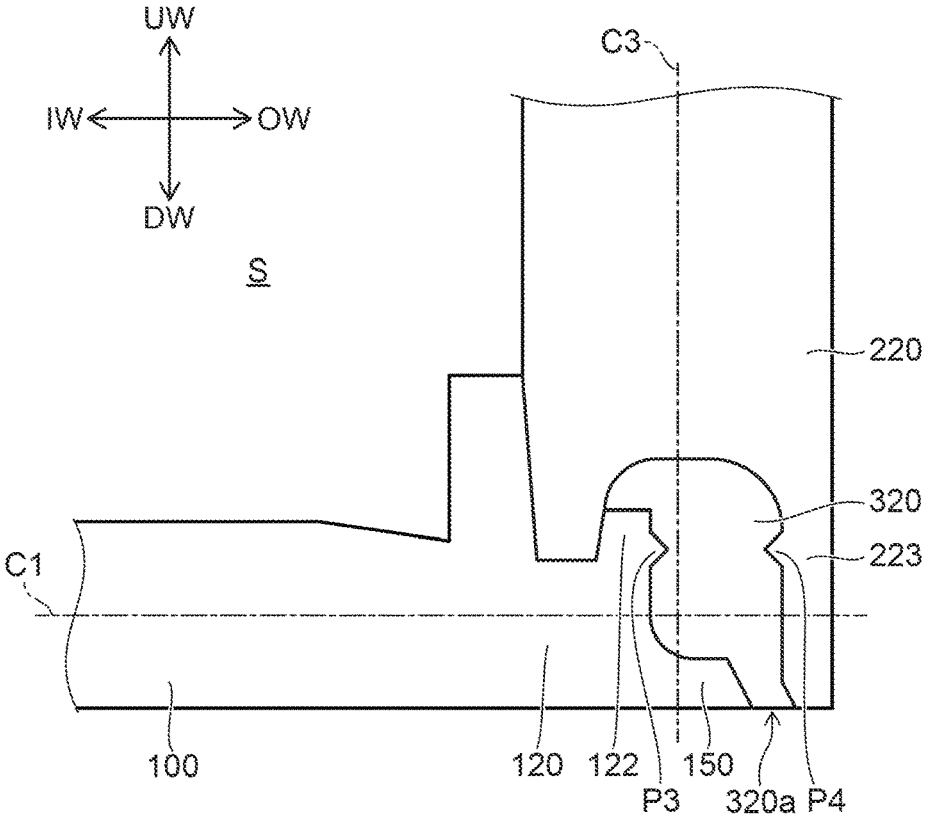
Figure 17A:
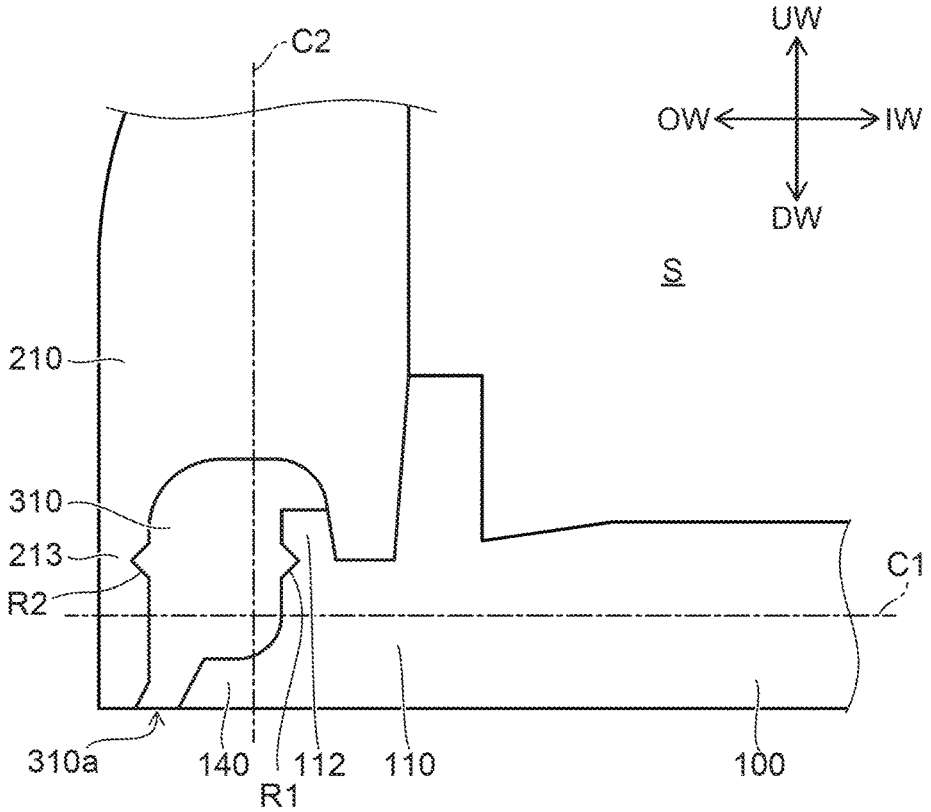
FIGS. 17A and 17B are cross-sectional views illustrating parts of toilet seats according to modifications of the embodiment.
Figure 17B:
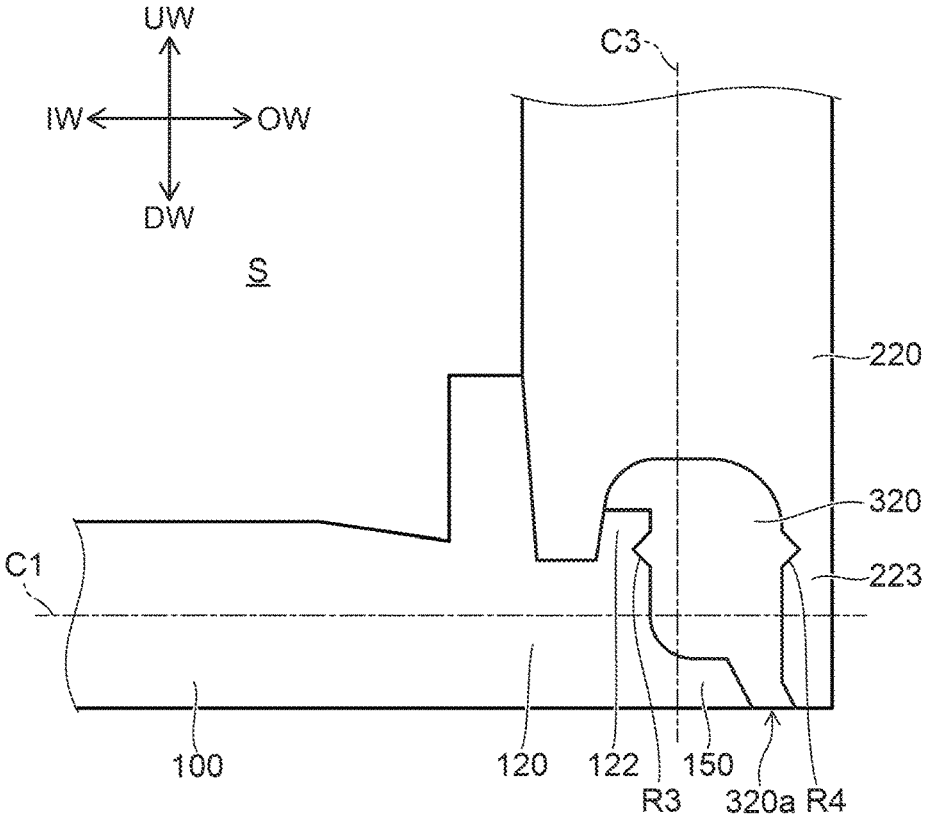

FIG. 9A to FIG. 17B are cross-sectional views illustrating parts of toilet seats according to modifications of the embodiment. FIG. 9A to FIG. 15 illustrate a part of the inner perimeter supporter 110 and a part of the inner perimeter sidewall part 210 for the toilet seats according to the modifications. FIG. 16A and FIG. 17A illustrate a part of the inner perimeter supporter 110 and a part of the inner perimeter sidewall part 210 for the toilet seats according to the modifications. FIG. 16B and FIG. 17B illustrate a part of the outer perimeter supporter 120 and a part of the outer perimeter sidewall part 220.

In the following description of the modifications, only the inner perimeter supporter 110 and the inner perimeter sidewall part 210 are described. These structures are applicable similarly to the outer perimeter supporter 120 and the outer perimeter sidewall part 220.

Figure 9A:
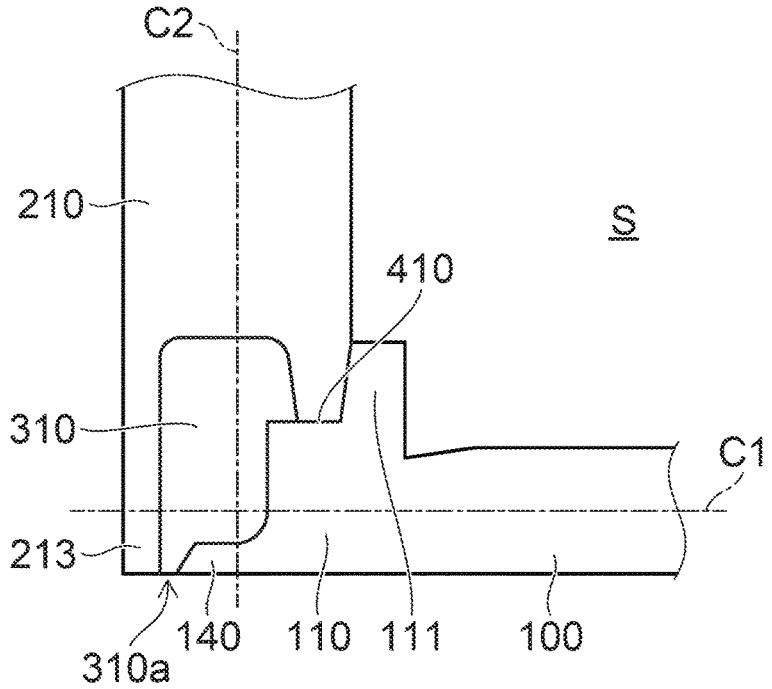
FIGS. 9A and 9B are cross-sectional views illustrating parts of toilet seats according to modifications of the embodiment.

As illustrated in FIG. 9A, the outer rib 112 may not be provided in the inner perimeter supporter 110. Or, instead of the outer rib 112, the inner rib 111 may not be provided in the inner perimeter supporter 110. However, it is desirable to provide both the inner rib 111 and the outer rib 112 to effectively relax the concentration of the stress at the inner perimeter supporter 110 and the inner perimeter sidewall part 210 when the load is applied to the toilet seat 10.

Figure 9B:
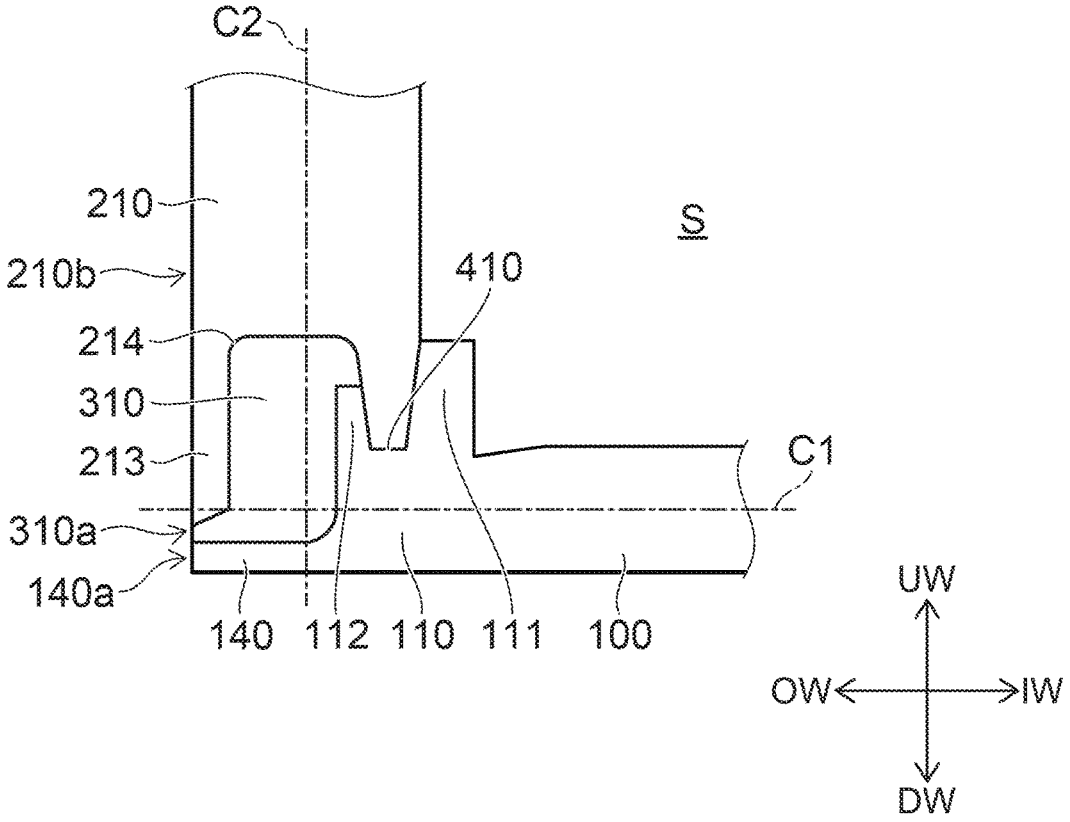

As illustrated in FIG. 9B, the hanging part 213 may be positioned above the protruding part 140. In such a case, in the vertical direction, the distance between the protruding part 140 and the hanging part 213 is shorter than the distance between the protruding part 140 and the recess 214. For example, the exposed surface 310*a* is provided to be coplanar along the vertical direction with an outer wall 210*b* of the inner perimeter sidewall part 210 and the tip surface 140*a* of the protruding part 140.

In the structure illustrated in FIG. 9B as well, the exposed surface 310*a* of the bonding member 310 is positioned below the central plane C1 of the bottom plate 100 and outward of the central plane C2 of the sidewall part 210. Therefore, similarly to the structure illustrated in FIG. 4 and FIG. 5, the gap does not occur easily around the exposed surface 310*a* (320*a*).

Figure 10A:
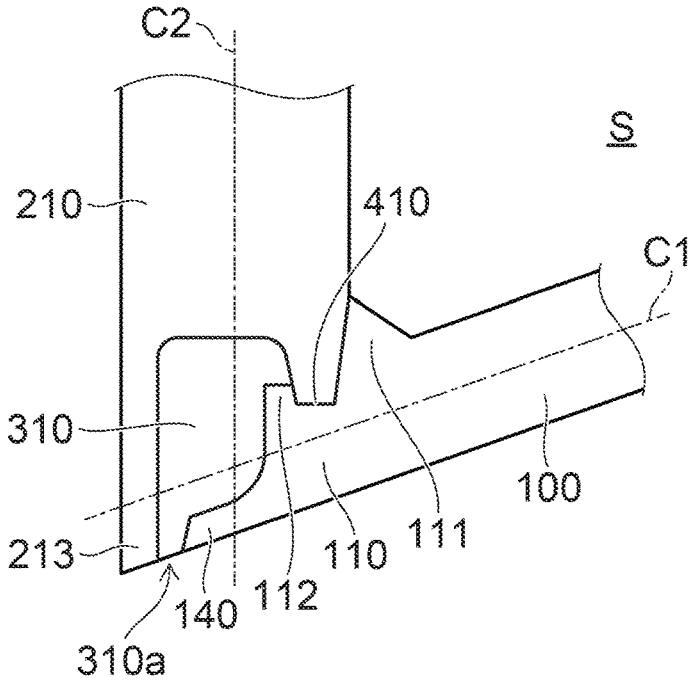
FIGS. 10A and 10B are cross-sectional views illustrating parts of toilet seats according to modifications of the embodiment.
Figure 10B:
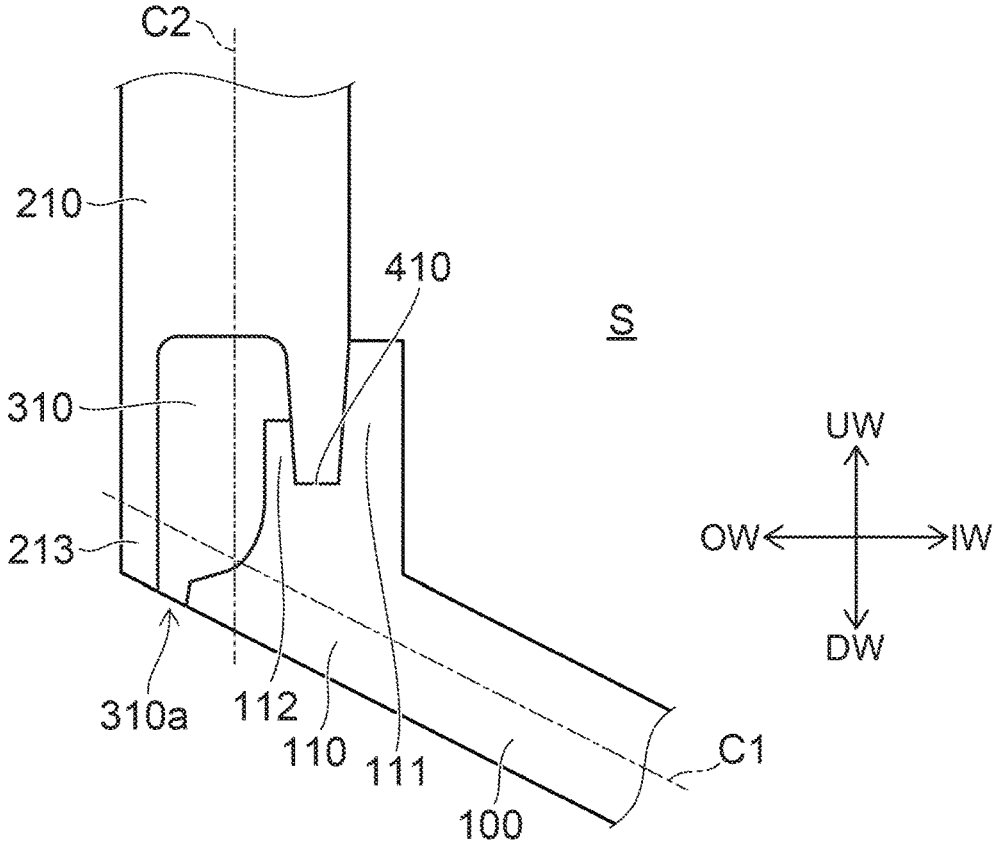

As illustrated in FIG. 10A and FIG. 10B, the bottom plate 100 may be tilted with respect to the horizontal direction. For example, as illustrated in FIG. 10A, the bottom plate 100 may be tilted in a direction upward and inward. Or, as illustrated in FIG. 10B, the bottom plate 100 may be tilted in a direction downward and inward. In the case of such structures, the central plane C1 of the bottom plate 100 also is tilted with respect to the horizontal direction.

Figure 11A:
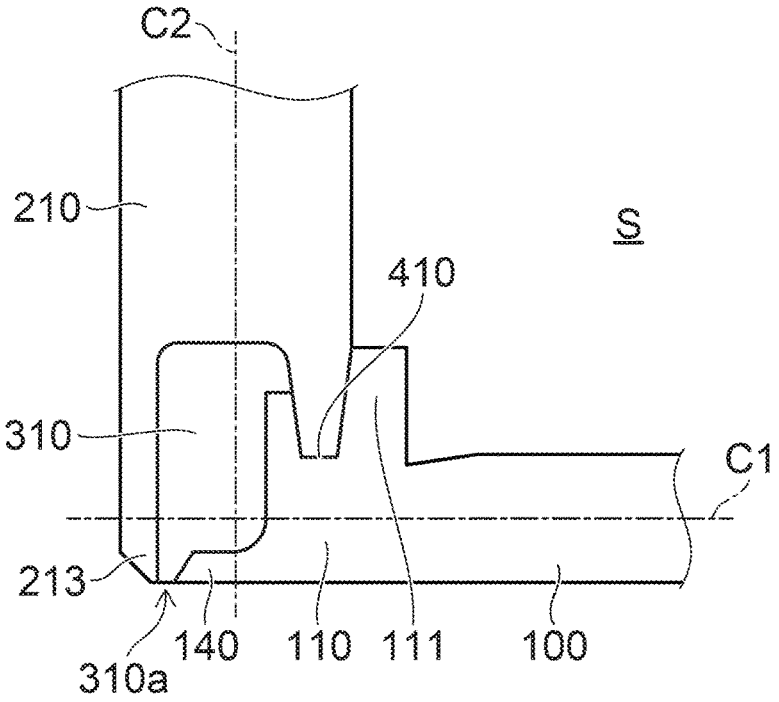
FIGS. 11A and 11B are cross-sectional views illustrating parts of toilet seats according to modifications of the embodiment.
Figure 11B:
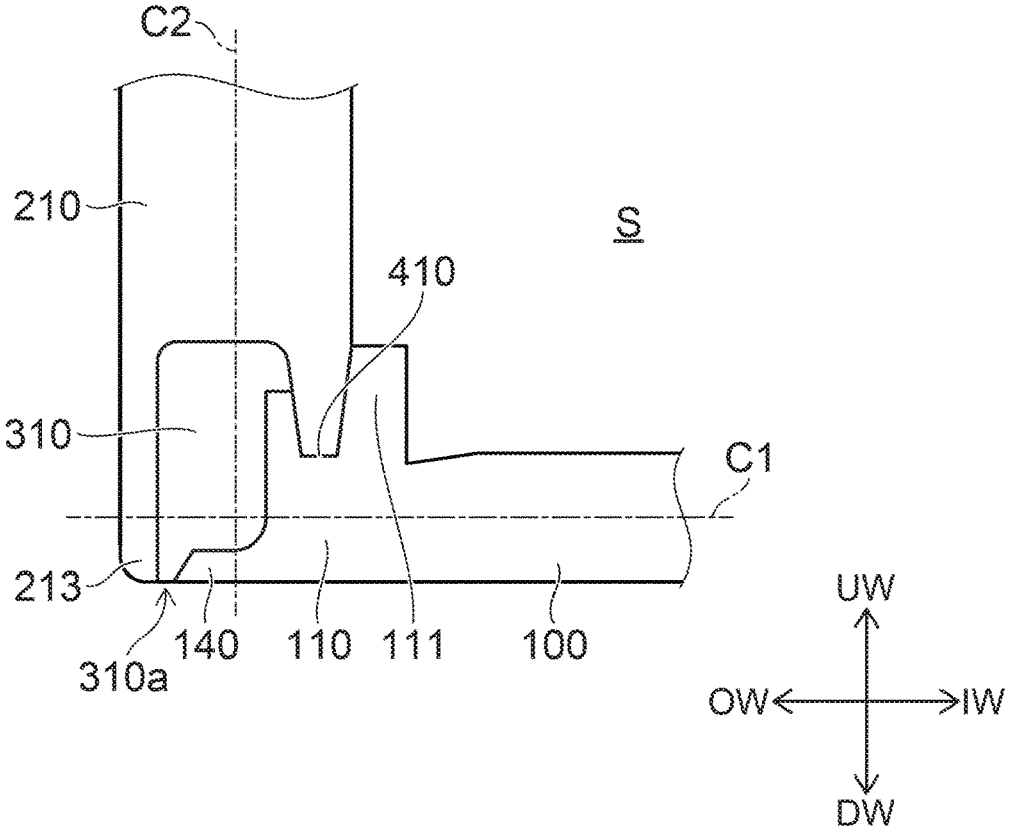
Figure 12A:
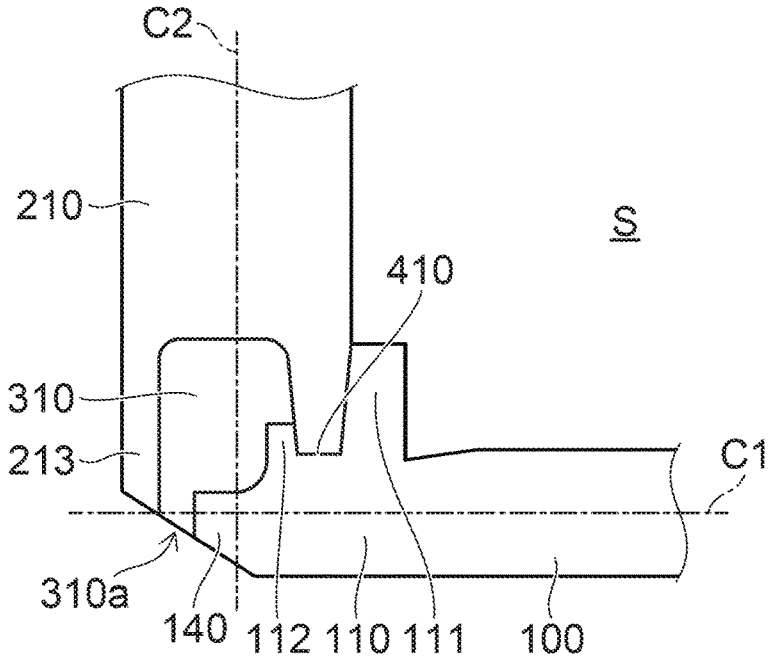
FIGS. 12A and 12B are cross-sectional views illustrating parts of toilet seats according to modifications of the embodiment.
Figure 12B:
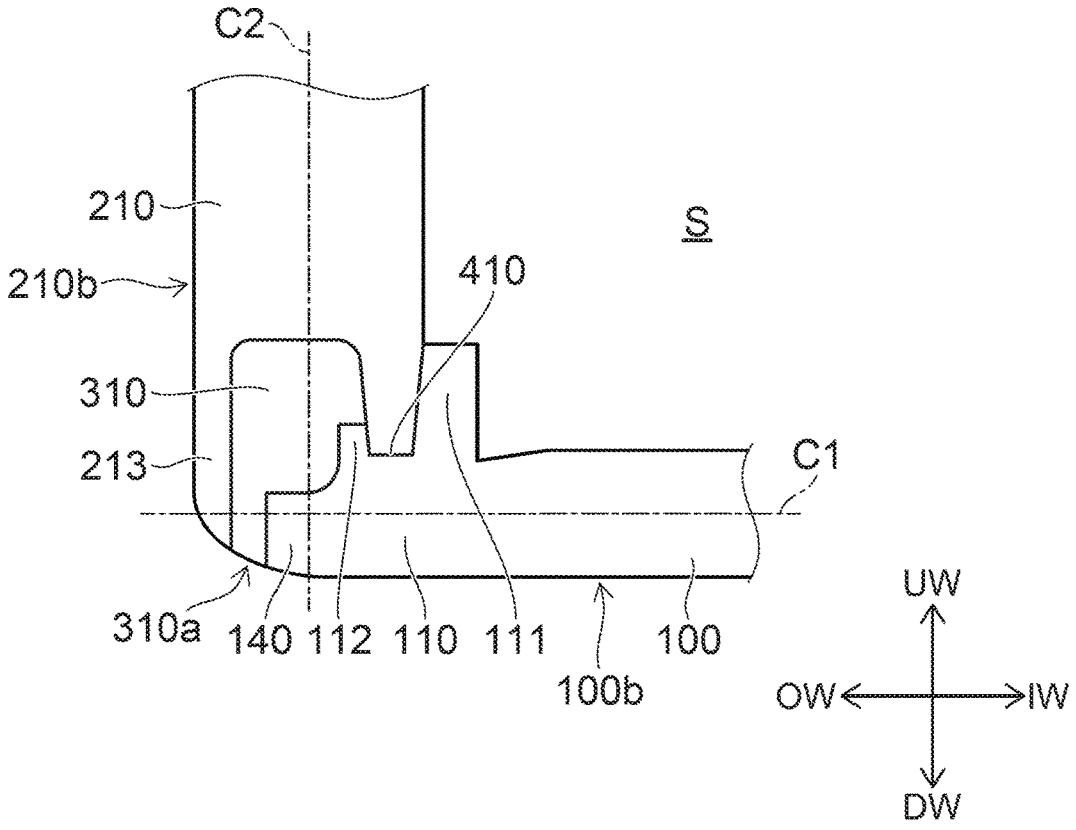

As illustrated in FIG. 11A, the tip of the hanging part 213 may be tilted. As illustrated in FIG. 11B, the tip of the hanging part 213 may be curved. As illustrated in FIG. 12A, the tip of the protruding part 140, the tip of the hanging part 213, and the exposed surface 310*a* of the bonding member 310 may be coplanar and tilted with respect to the horizontal direction and the vertical direction. Or, as illustrated in FIG. 12B, the tip of the protruding part 140, the tip of the hanging part 213, and the exposed surface 310*a* of the bonding member 310 may be curved and smoothly continuous with a bottom surface 100*b* of the bottom plate and the outer wall 210*b* of the sidewall part 210.

Figure 13A:
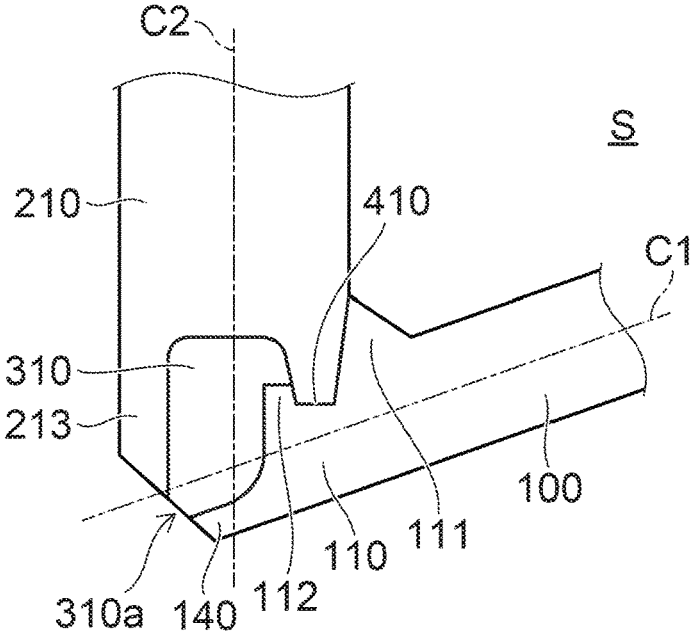
FIGS. 13A and 13B are cross-sectional views illustrating parts of toilet seats according to modifications of the embodiment.
Figure 13B:
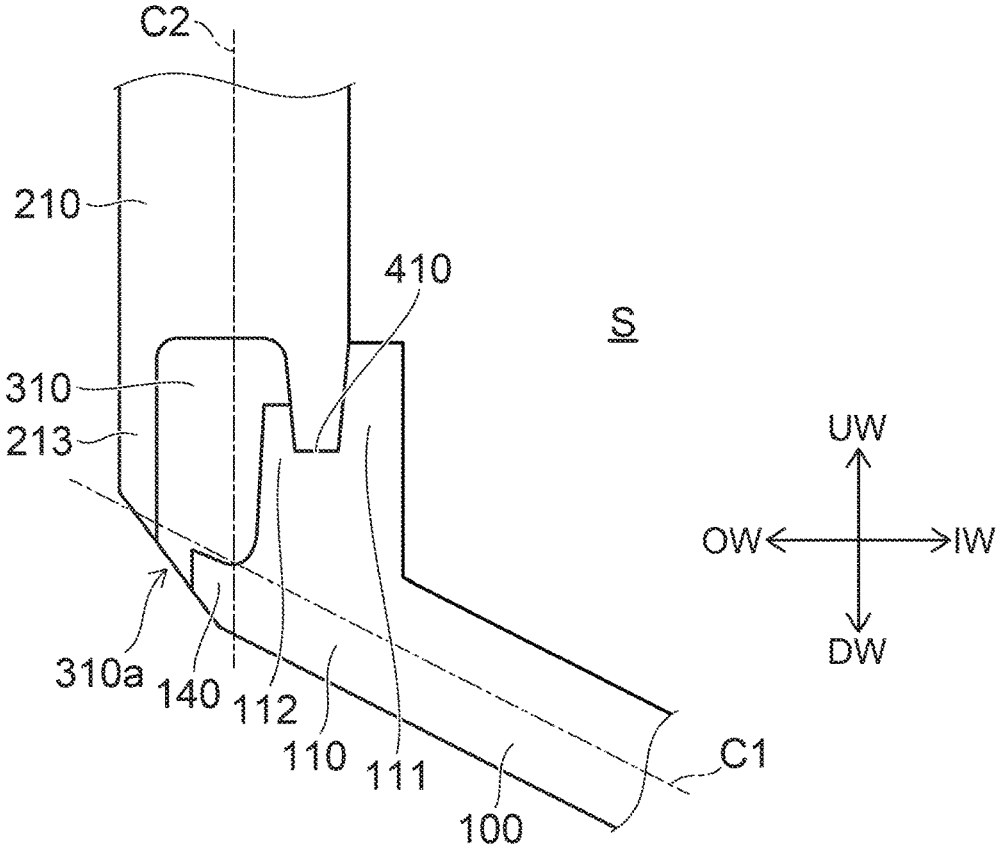

Or, as illustrated in FIG. 13A, the bottom plate 100 of the structure illustrated in FIG. 12A also may be tilted in a direction upward and inward. Or, as illustrated in FIG. 13B, the bottom plate 100 of the structure illustrated in FIG. 12A also may be tilted in a direction downward and inward. The exposed surface 310*a* of the structures illustrated in FIG. 13A and FIG. 13B may be curved as illustrated in FIG. 12B.

Figure 14:
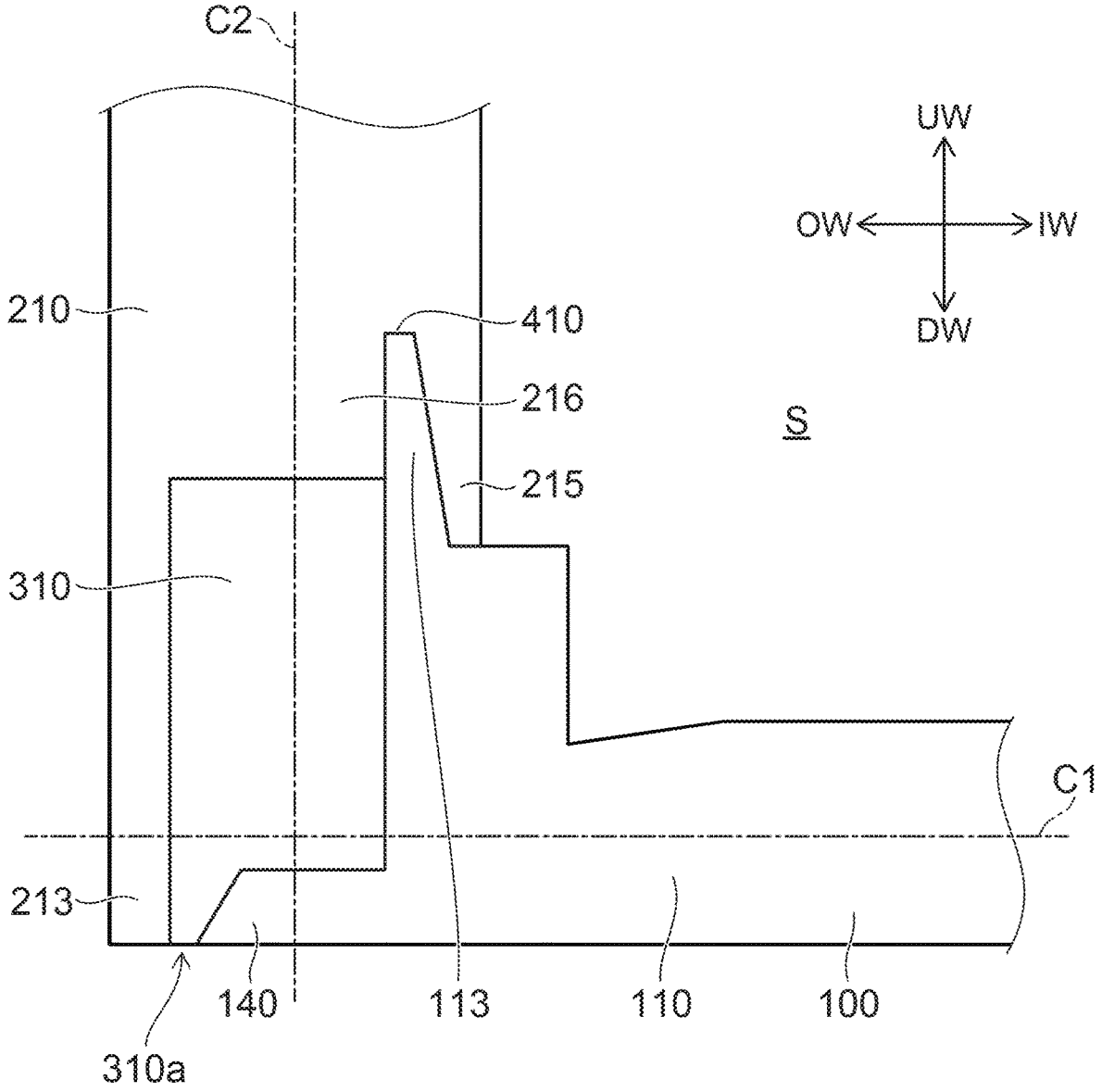
FIG. 14 is a cross-sectional view illustrating parts of toilet seats according to modifications of the embodiment.

In the structures of the toilet seats 10 described above, the engaging part 410 is provided in the inner perimeter sidewall part 210. Conversely, as illustrated in FIG. 14, the engaging part 410 may be provided in the inner perimeter supporter 110.

Specifically, the inner perimeter supporter 110 includes an insertion part 113; and the inner perimeter sidewall part 210 includes the hanging part 213, an inner rib 215, and an outer rib 216. For example, the inner rib 215 faces the interior space S. The outer rib 216 is provided outward of the inner rib 215. The insertion part 113 is provided between the inner rib 215 and the outer rib 216; and the engaging part 410 of the upper end of the insertion part 113 abuts the sidewall part 210. The bonding member 310 is surrounded with the inner perimeter supporter 110, the protruding part 140, the hanging part 213, and the outer rib 216.

As described above, to effectively reduce the stress generated in the inner perimeter supporter 110 and the inner perimeter sidewall part 210, it is desirable for the engaging part 410 to be positioned above the central plane C1 and positioned inward of the central plane C2. In such a case, a large compressive stress is generated at the engaging part 410 vicinity. To prevent damage due to the compressive stress, it is desirable for the thickness of the inner rib 215 (the dimension in a direction perpendicular to the circumferential direction of the toilet seat 10) to be large and for the strength of the inner rib 215 to be high. The thickness of the inner perimeter sidewall part 210 also increases when the thickness of the inner rib 215 is increased. In the case where the thickness of the inner perimeter sidewall part 210 is increased, the heating function degrades in the case where a heating device is provided in the toilet seat 10 interior, or the sizes and/or the functions of the members that can be included in the toilet seat 10 and/or the interior space S are constrained.

Accordingly, for example, it is desirable for the engaging part 410 to be provided in the inner perimeter sidewall part 210 as illustrated in FIG. 4. In such a case, at least one of the inner rib 111 or the outer rib 112 is provided in the inner perimeter supporter 110. However, the increase of the thicknesses of these ribs substantially does not affect the dimension in the horizontal direction of the bottom plate 100.

As illustrated in FIG. 15, the inner perimeter supporter 110 and the inner perimeter sidewall part 210 each may include insertion parts. Specifically, the inner perimeter supporter 110 includes the inner rib 111, the outer rib 112, and the insertion part 113. The insertion part 113 is positioned between the inner rib 111 and the outer rib 112 and is separated from these ribs. The inner perimeter sidewall part 210 includes an insertion part 212*a*, an insertion part 212*b*, the hanging part 213, and the recess 214. In other words, the inner perimeter sidewall part 210 includes multiple insertion parts.

The insertion part 212*a* is provided between the inner rib 111 and the insertion part 113. The insertion part 212*b* is provided between the insertion part 113 and the outer rib 112. An engaging part 410*a* of the lower end of the insertion part 212*a* and an engaging part 410*b* of the lower end of the insertion part 212*b* abut the inner perimeter supporter 110 and are supported from below by the inner perimeter supporter 110.

The structure is not limited to the structure illustrated in FIG. 15; and multiple insertion parts may be provided in the inner perimeter supporter 110. Or, multiple insertion parts may be provided in both the inner perimeter supporter 110 and the inner perimeter sidewall part 210. In such structures, it is desirable for the engaging part of the lower end of each insertion part of the inner perimeter sidewall part 210 to be positioned above the central plane C1 and positioned inward of the central plane C2.

As illustrated in FIG. 16A, a protrusion P1 that protrudes sideward toward the hanging part 213 may be provided in the inner perimeter supporter 110. For example, the protrusion P1 is provided in the side surface of the outer rib 112. A protrusion P2 that protrudes sideward toward the inner perimeter supporter 110 may be provided in the hanging part 213. For example, the protrusion P1 and the protrusion P2 oppose each other in the horizontal direction.

By providing the protrusion P1 and the protrusion P2, even when the bottom plate 100 and the top plate 200 peel from the bonding member 310, the bonding member 310 catches on the protrusion P1 and the protrusion P2. The movement in the vertical direction with respect to the bonding member 310 and the separation from the bonding member 310 of the bottom plate 100 and the top plate 200 can be suppressed thereby.

Similarly, as illustrated in FIG. 16B, a protrusion P3 that protrudes sideward toward the hanging part 223 may be provided in the outer perimeter supporter 120. A protrusion P4 that protrudes sideward toward the outer perimeter supporter 120 may be provided in the hanging part 223.

Or, as illustrated in FIG. 17A, a recess R1 that is recessed sideward may be provided in the inner perimeter supporter 110. For example, the recess R1 is provided in the side surface of the outer rib 112. A recess R2 that is recessed sideward may be provided in the hanging part 213. For example, the recess R1 and the recess R2 oppose each other in the horizontal direction. Parts of the bonding member 310 are provided inside the recess R1 and inside the recess R2.

By providing the recess R1 and the recess R2, even in the case where the bottom plate 100 and the top plate 200 peel from the bonding member 310, the bonding member 310 that is provided inside the recess R1 and inside the recess R2 catches on the bottom plate 100 and the top plate 200. The movement in the vertical direction with respect to the bonding member 310 and the separation from the bonding member 310 of the bottom plate 100 and the top plate 200 can be suppressed thereby.

Similarly, as illustrated in FIG. 17B, a recess R3 that is recessed sideward may be provided in the outer perimeter supporter 120. A recess R4 that is recessed sideward may be provided in the hanging part 223.

The examples described above can be performed in combination as appropriate. For example, the tilted surface or the curved surface illustrated in FIG. 11A, FIG. 11B, FIG. 12A, or FIG. 12B may be provided in the structure illustrated in FIG. 10A or FIG. 10B. For example, the engaging part that has the structure illustrated in FIG. 9A, FIG. 9B, FIG. 14, or FIG. 15 may be provided in the structure having the tilted surface or the curved surface illustrated in FIG. 11A, FIG. 11B, FIG. 12A, or FIG. 12B.

The toilet seat 10 according to the embodiment is not limited to the examples described above; and as long as the exposed surface 310*a* (320*a*) is below the central plane C1 and outward of the central plane C2 (C3), the configurations, the structures, and the dimensions of the components may be modified as appropriate.

The embodiments of the invention have been described, however, are not limited to these descriptions. Any addition of design change appropriately made by a person skilled in the art in regard to the embodiments described above is also encompassed with the scope of the invention as long as it falls within the feature of the invention. For example, the size, the material, the disposition, and the installation mode of the components included in the bottom plate 100 and the top plate 200 or the like are not limited to the illustration, and can be appropriately modified.

The components included in the embodiments described above can be combined to the extent of technical feasibility and the combinations are included in the scope of the embodiments to the extent that the feature of the embodiments is included.

What is claimed is:

1. A toilet seat, comprising:

a bottom plate made of resin;

a top plate including a sidewall part and a seating part, the sidewall part being provided on the bottom plate along a vertical direction, the seating part being supported by the sidewall part, the top plate being made of resin; and a bonding member bonding the bottom plate and the sidewall part, the bonding member having an exposed surface exposed externally, a first boundary between the exposed surface and the top plate and a second boundary between the exposed surface and the bottom plate being positioned below a central plane of the bottom plate and positioned outward of a central plane of the sidewall part, the central plane of the bottom plate corresponding to a plane connecting a plurality of center points of the thickness of the bottom plate, and the central plane of the sidewall part corresponding to a plane connecting a plurality of center points of the thickness of the sidewall part.

2. The toilet seat according to claim 1, further comprising an engaging part where the bottom plate and the sidewall part engage, the engaging part being positioned above the central plane of the bottom plate and positioned inward of the central plane of the sidewall part.

3. The toilet seat according to claim 2, wherein the engaging part is provided at a lower end of an inner wall of the sidewall part.

4. The toilet seat according to claim 1, wherein the bottom plate includes:

a supporter abutting the sidewall part from below and supporting the sidewall part from below; and a protruding part protruding outward from the supporter, a hanging part is provided in a lower end of the sidewall part, the hanging part extending downward and being separated from the protruding part, at least a part of the bonding member is provided, in a horizontal direction, between the hanging part and the supporter and between the hanging part and the protruding part, and in the horizontal direction, a distance between the hanging part and the protruding part is shorter than a distance between the hanging part and the supporter.

* * * * *